US006446879B1

(12) United States Patent
Kime

(10) Patent No.: US 6,446,879 B1
(45) Date of Patent: Sep. 10, 2002

(54) METHOD AND APPARATUS FOR DEPOSITING SNOW-ICE TREATMENT MATERIAL ON PAVEMENT

(75) Inventor: James A. Kime, Columbus, OH (US)

(73) Assignee: H.Y.O., Inc.

( * ) Notice: Subject to any disclaimer, the term of this patent is extended or adjusted under 35 U.S.C. 154(b) by 0 days.

(21) Appl. No.: 09/512,199

(22) Filed: Feb. 24, 2000

Related U.S. Application Data

(60) Continuation-in-part of application No. 09/314,098, filed on May 18, 1999, now Pat. No. 6,068,200, which is a division of application No. 09/018,294, filed on Feb. 4, 1998, now Pat. No. 5,988,535.

(51) Int. Cl.[7] ..... B05B 17/04

(52) U.S. Cl. ..... 239/7; 239/170; 239/667; 239/673; 239/675; 239/680; 239/682

(58) Field of Search ..... 239/7, 146, 159, 239/176, 656, 657, 665, 666, 667, 670, 672, 673, 675, 680, 681, 682, 684, 687, 170

(56) References Cited

U.S. PATENT DOCUMENTS

| | | | | |
|---|---|---|---|---|
| 3,332,691 A | | 7/1967 | Swenson et al. | |
| 3,559,893 A | * | 2/1971 | Gruben | 239/682 |
| 3,693,890 A | * | 9/1972 | Torrey | 239/672 |
| 4,106,703 A | * | 8/1978 | Magda | 239/656 |
| RE33,835 E | | 3/1992 | Kime et al. | |
| 5,096,125 A | * | 3/1992 | Wise et al. | 239/675 |
| 5,318,226 A | | 6/1994 | Kime et al. | |
| 5,386,943 A | * | 2/1995 | Peeters | 239/675 |
| 5,772,389 A | * | 6/1998 | Feller | 239/672 |
| 5,842,649 A | | 12/1998 | Beck et al. | |
| 5,911,362 A | * | 6/1999 | Wood et al. | 239/155 |
| 5,931,393 A | * | 8/1999 | Alsip et al. | 239/675 |
| 5,947,391 A | | 9/1999 | Beck et al. | |
| 6,173,904 B1 | * | 1/2001 | Doherty et al. | 239/675 |

OTHER PUBLICATIONS

Tyler Industries, Inc., "Roads & Bridges", magazine, Dec., 1995, pp. 28–29, Scranton Gillette Communications, Inc., Des Plaines, IL.

* cited by examiner

*Primary Examiner*—Lesley D. Morris
*Assistant Examiner*—Dinh Q. Nguyen
(74) *Attorney, Agent, or Firm*—Mueller and Smith, LPA

(57) ABSTRACT

Apparatus and method for depositing salt granular materials upon a highway pavement at practical speeds. A highway truck is utilized which employs two spaced apart ejector mechanisms which function to deposit a continues narrow band of mixed salt and brine just forwardly of and in the path of travel of the two rearward truck wheel assemblies. This not only provides enhanced traction for these rear truck wheels, but also functions to utilize the rear wheels to compact the continuous narrow band pile of salt into pavement borne ice formations. Granular salt is delivered to the two ejector mechanisms utilized from a truck bed having a flat surface beneath which is a centrally disposed bed auger transport mechanism formed of two independently driven augers. These augers deliver salt to a cross auger mechanism mounted forwardly of the bed and which both supports and delivers salt to the two spaced apart ejectors. A brine formation assembly also is mounted upon the truck frame rearwardly of the truck cab and forwardly of the bed. By selectively actuating one or the other of the bed augers, granular salt and brine may be ejected from an elected one or both of the ejector mechanisms. This brine supply also is used for coating dry bridge decks prior to imminent icing weather.

36 Claims, 11 Drawing Sheets

FIG. 8
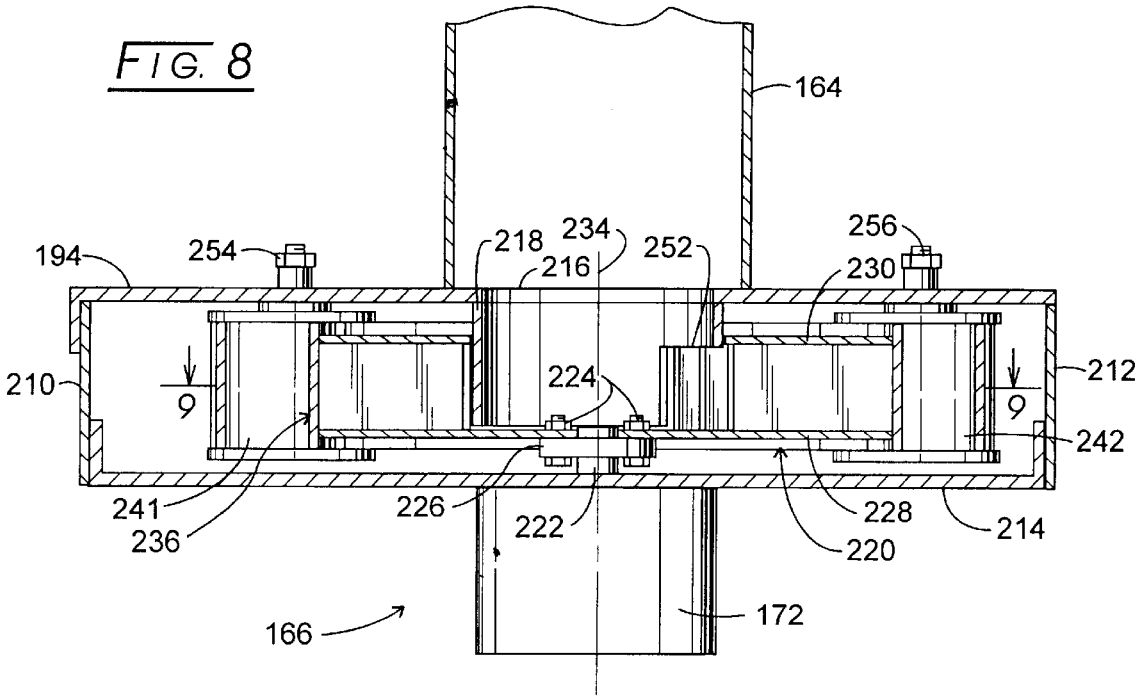
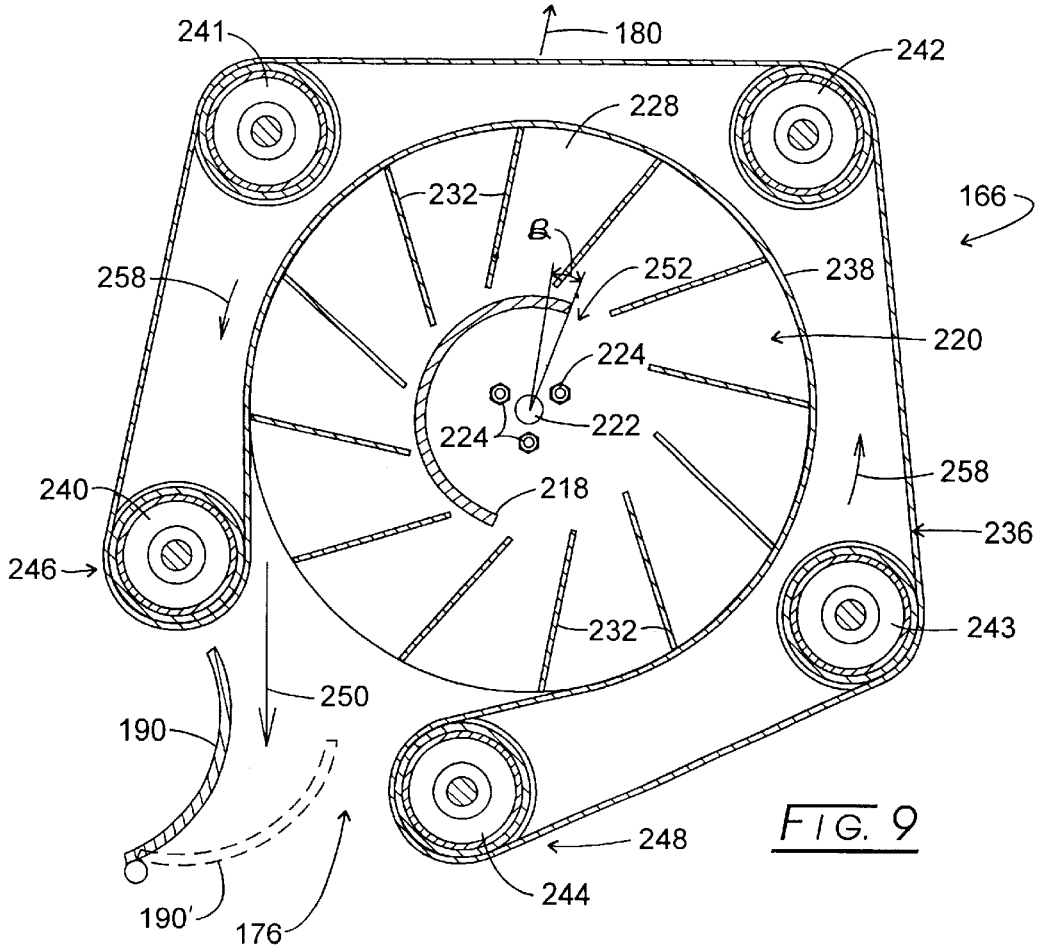
FIG. 9

POWER UP
490
492
INITIALIZATION
494
496
ENTER MAIN LOOP
498
538
500
MODULE SELECT
502
504
506
CONFIGURATION
508
DATA LOG
510
COMMUNICATIONS
512
PRESSURE READINGS
514
FLUID TEMP
516
FAULT HANDLING
518
PLOW HANDLING
520
BED CONTROL
522
SPEED
526
SPINNER
528
WETTER
530
AUGER
EJECTOR
524
532
USER INTERFACE (DISPLAY) (CALIBRATION)
534
RETURN
536
538

METHOD AND APPARATUS FOR DEPOSITING SNOW-ICE TREATMENT MATERIAL ON PAVEMENT

CROSS-REFERENCE TO RELATED APPLICATIONS

This application is a continuation-in-part of application Ser. No. 09/314,098 filed May 18, 1999 now U.S. Pat. No. 6,068,200 issued May 30, 2000, which is a division of application Ser. No. 09/018,294 filed Feb. 4, 1998, now U.S. Pat. No. 5,988,535 issued Nov. 23, 1999.

BACKGROUND OF THE INVENTION

Highway snow and ice control typically is carried out by governmental authorities with the use of dump trucks which are seasonally modified by the addition of snow-ice treatment components. These components will include the forwardly-n-mounted plows and rearwardly-mounted mechanisms for broadcasting materials such as salt or salt-aggregate mixtures. The classic configuration for the latter broadcasting mechanisms included a feed auger extending along the back edge of the dump bed of the truck. This hydraulically driven auger effects a metered movement of material from the bed of the truck onto a rotating spreader disk or "spinner" which functions to broadcast the salt across the pavement being treated. To maneuver the salt-based material into the auger, the dump bed of the truck is progressively elevated as the truck moves along the highway to be treated. Thus, when into a given run, the dump bed will be elevated, dangerously raising the center of gravity of the truck under inclement driving conditions.

An initial improvement in the controlled deposition of salt materials and the like has been achieved through the utilization of microprocessor driven controls over the hydraulics employed with the seasonally modified dump trucks. See Kime, et al. in U.S. Pat. No. Re 33,835, entitled "Hydraulic System for Use with Snow-Ice Removal Vehicles", reissued Mar. 3, 1992. This Kime, et al. patent describes a microprocessor-driven hydraulic system for such trucks with a provision for digital hydraulic valving control which is responsive to the instantaneous speed of the truck. With the hydraulic system, improved controls over the extent of deposition of snow-ice materials is achieved. This patent is expressly incorporated herein by reference.

Investigations into techniques for controlling snow-ice pavement envelopment have recognized the importance of salt in the form of salt brine in breaking the bond between ice and the underlying pavement. Without a disruption of that bond, little improvement to highway traction will be achieved. For example, the plow merely will scrape off the snow and ice to the extent possible, only to leave a slippery coating which may be more dangerous to the motorist than the pre-plowed road condition.

When salt has been simply broadcast over an ice laden pavement from a typical spinner, it will have failed to form a brine of sufficient salt concentration to break the ice-pavement bond. The result usually is an ice coated pavement, in turn, coated with a highly dilute brine solution developed by too little salt, which will have melted an insufficient amount of ice for traction purposes. This condition is encountered often where granular salt material contains a substantial amount of "fines ". Fines are very small salt particles typically generated in the course of transporting, stacking, and storing road maintenance salt in dome-shaped warehouses and the like.

Road snow-ice control studies have revealed that the activity of ice melting serving to break the noted ice-pavement bond is one of creating a saltwater brine of adequate concentration. In general, an adequate salt concentration using conventional dispersion methods requires the distribution of unacceptable quantities of salt on the pavement. Some investigators have employed a saturated brine as the normal treatment modality by simply pouring it on the ice covered highway surface from a lateral nozzle-containing spray bar mounted behind a truck. A result has been that the- thus-deposited brine concentration essentially immediately dilutes to ineffectiveness at the ice surface, with a resultant dangerous liquid-coated ice highway condition.

Attempting to remove ice from pavement by dissolving the entire amount present over the entire expanse of pavement to be treated is considered not to be acceptable from an economical standpoint. For example, a one mile, 12 foot wide highway lane with a ¼ inch thickness of ice over it should require approximately four tons of salt material to make a 10% brine solution and create bare pavement at 20° F. Technical considerations for developing a salt brine effective to achieve adequate ice control are described, for example, by D. W. Kaufman in "Sodium Chloride: The Production and Properties of Salt and Brine", Monograph Series 145 (Amer. Chem. Soc. 1960).

The spreading of a combination of liquid salt brine and granular salt has been considered advantageous. In this regard, the granular salt may function to maintain a desired concentration of brine for attacking the ice-pavement bond and salt fines are more controlled by dissolution in the mix. The problem of excessive salt requirements remains, however, as well as difficulties in mixing a highly corrosive brine with particulate salt. Typically, nozzle injection of the brine is the procedure employed. However, attempts have been made to achieve the mix by resorting to the simple expedient of adding concentrated brine over the salt load in a dump bed. This approach is effective to an extent. However, as the brine passes through the granular salt material, it dissolves the granular salt such that the salt will not remain in solution and will recrystallize, causing bridging phenomena and the like inhibiting its movement into a distribution auger.

The problem of the technique of deposition of salt in a properly distributed manner upon the highway surface also has been the subject of investigation. Particularly where bare pavement initially is encountered, snow/ice materials utilized in conventional equipment will remain on the highway surface at the time of deposition only where the depositing vehicles are traveling at dangerously slow speeds, for example about 15 mph. Above those slow speeds, the material essentially is lost to the roadside. Observation of materials attempted to be deposited at higher speeds shows the granular material bouncing forwardly, upwardly, and being broadcast over the pavement sides such that deposition at higher speeds is ineffective as well as dangerous and potentially damaging to approaching vehicles. That latter damage sometimes is referred to as "collateral damage". However, the broadcasting trucks themselves constitute a serious hazard when traveling, for example at 15 mph, particularly on dry pavement, which simultaneously is accommodating vehicles traveling, for example at 65 mph. The danger so posed has beer, considered to preclude the highly desirable procedure of depositing the salt material on dry pavement just before the onslaught of snow/ice conditions. Of course, operating at such higher speeds with elevated dump truck beds also poses a hazardous situation.

In addition to the hazards posed by slow speeds of travel, trucks utilized for snow-ice treatment exhibit difficulties negotiating ice coated highways, particularly where uphill grades are encountered. One technique for driving upon such ice coated hills has been to turn the trucks around, activate the rear mounted salt broadcasting spinner and travel up the incline in reverse gear. This procedure achieves only marginal traction and is manifestly an undesirable solution to this traction problem.

Kime, et al., in U.S. Pat. No. 5,318,226 entitled "Deposition of Snow-ice Treatment Material from a Vehicle with Controlled Scatter", issued Jun. 7, 1994, (incorporated herein by reference) describes an effective technique and mechanism for controlling the scatter of the so-called granules at higher speeds. With the method, the salt materials are propelled from the treatment vehicle at a velocity commensurate with that of the vehicle itself and in a direction opposite that of the vehicle. The result is an effective suspension of the projected materials over the surface under a condition of substantially zero velocity with respect to or relative to the surface of deposition. Depending upon vehicle speeds desired, material deposition may be provided in controlled widths ranging from narrow to wider bands to achieve a control over material placement. Another "zero-velocity" method for salt distribution employing a different apparatus approach has been introduced by Tyler Industries, Inc. of Benson, Minn. See "Roads & Bridges", Dec. 1995, Scranton Gillette Communications, Inc., Des Plaines, Ill. See also, U.S. Pat. No. 5,842,649 and 5,947,391 by Beck et al.

A practical technique for generating a brine of sufficient concentration to break the ice pavement bond is described in U.S. Pat. No. 5,988,535 entitled "Method and Apparatus for Depositing Snow-Ice Treatment Material on Pavement by Kime, issued Nov. 23, 1999 and incorporated herein by reference. With this technique, ejectors are employed to deposit a salt-brine mixture upon a highway as a relatively narrow, continuous and compact band of material. To achieve such narrow band material deposition at practical highway speeds of 40 mph or more, the salt-brine mixture is propelled from the treatment vehicle at a velocity commensurate with that of the vehicle itself and in a direction opposite that of the vehicle. Further, the material is downwardly directed at an acute angle with respect to the plane defined by the pavement. When the salt-brine narrow band is deposited at the superelevated side of a highway lane, the resultant concentrated brine from the band is observed to gravitationally migrate toward the opposite or downhill side of the treated lane to provide expanded ice clearance. The result is a highly effective snow-ice treatment procedure with an efficient utilization of salt materials. Because the lanes of modem highways are superelevated in both a right and a left sense, two spaced apart salt ejectors are employed to deposit the narrow band concentration at positions corresponding with the tire tracks of vehicles located at the higher or elevated portion of a pavement lane. A feature of the apparatus of this system is its capability for being mounted and demounted upon the dump bed of a conventional highway maintenance truck in a relatively short interval of time. As a consequence, these damp trucks are readily available for carrying out tasks not involving snow-ice control. Additionally, the apparatus is configured such that the dump beds remain in a lowered or down position throughout their use, thus improving the safety aspect of their employment during inclement winter weather.

BRIEF SUMMARY OF THE INVENTION

The present invention is addressed to apparatus and method for depositing salt based snow-ice treatment material upon pavement from a vehicle moving at practical highway speeds. A truck having a dump bed is employed for this deposition which is customized to deposit mixed salt and brine material on a highway as a continuous narrow band which is configured to evoke and maintain a brine at the highway having a salt concentration effective to break an ice-pavement bond. Two of these continuous bands may be deposited from a forward location on the truck such that the bands are formed within the path of travel of its rear wheels. As these wheels encounter the deposited salt band, they function to compact or compress the continuous granular salt pile into the ice formation on the pavement to enhance the development of a high salt concentration brine and to promote resultant breakup of the ice layer. In addition to this highly desirable aspect, the snow-ice control truck is afforded substantially improved traction over pavement ice so as to enjoy a capability for negotiating highway grades with greater control and safety.

Even though the truck is customized to carry salt and brine materials and the apparatus of their deposition, its dump bed advantageously may be used for other tasks not concerned with snow-ice control. In this regard, the bottom surface of the dump bed is flat and surmounts an elongate, centrally disposed chamber housing a salt transport mechanism which is positioned below the dump bed surface. Fortuitously, salt granules carried in the dump bed can be caused to dynamically migrate toward the central transport mechanism with the simple expedient of slightly elevating the dump bed and then dropping it in a "down fast" operator controlled maneuver. The flat surface dump bed readily is converted for other tasks by covering over the centrally disposed chamber with a sequence of cover plates.

The ejectors which are mounted forwardly on the vehicle are utilized to form the narrow bands function to eject the salt based material rearwardly toward the rear tire assemblies both at a velocity commensurate with the forward speed of the vehicle and at a downward direction toward the pavement. The extent of this downward direction is that of an acute angle of about 15° with respect to the instantaneous plane of the highway pavement. This downward direction causes the narrow band deposition to occur within a relatively short distance from the ejector mechanism such that the continuous band shaped piles of granular salt and brine are formed with stability upon the highway pavement just prior to being traveled over and compacted by the rearwardly disposed wheel assemblies of the truck.

Maneuvering of granular salt to the forwardly mounted, spaced apart ejector mechanisms initially is by operation of the centrally located bed mounted transport mechanism. When the bed is in its lower or down position, this transport assembly passes granular salt to a cross transport mechanism mounted upon the truck frame just forwardly of the front of the dump bed. This transversely oriented transport mechanism both supports the two ejector mechanisms and conveys the granular salt to their inputs. To provide an operational feature wherein the operator of the vehicle may optionally deposit a salt band from one or both ejectors, the bed transport mechanism is configured as two independently driven augers. These independent augers feed granular salt to two directionally configured flight sequences of an auger utilized as the cross transport mechanism. Thus, an operator election for depositing salt from one or both ejector mechanisms is made by driving one or both of the bed supported augers.

A brine formation and dispensing assembly is mounted forwardly on the truck just behind its cab and positioned over the cross transport assembly. This brine developing mechanism dispenses formed brine liquid into the cross transport mechanism for carrying out an efficient mixing of it with granular salt. The assembly is charged through an upwardly opening hopper defining structure, a portion of which extends over the top of the cab. With the arrangement, this brine formation structure can be loaded with brine forming granular materials utilizing the same front end loader vehicle as is used for filling the dump bed with salt material. An additional advantage accrues from this vehicle mounted brine formation and dispensing assembly. Motorists in the northern climates are familiar with highway signage advising that the decks of bridges ice over before earth-supported normal roadways. The in situ brine formation assembly can be used to dispense brine from a spray bar extending transversely across the truck as the trucks encounter bridge deck pavement prior to the formation of ice. Because the brine is placed upon the bridge deck before the onslaught of icing weather, it becomes quite effective in combating the initial formation of ice on the bridge.

Other objects of the invention will, in part, be obvious and will, in part, appear hereinafter. The invention, accordingly, comprises the apparatus and the method possessing the construction, combination of elements, arrangement of parts, and steps which are exemplified in the following description.

For a fuller understanding of the nature and objects of the invention, reference should be made to the following detailed description taken in connection with the accompanying drawings.

BRIEF DESCRIPTION OF THE DRAWINGS

FIG. 8 is a partial sectional view of an ejector mechanism shown in FIG. 1;

FIG. 9 is a partial sectional view of an ejector employed with the apparatus of the invention taken through the plane 9—9 in FIG. 8;

DETAILED DESCRIPTION OF THE INVENTION

Figure 1:
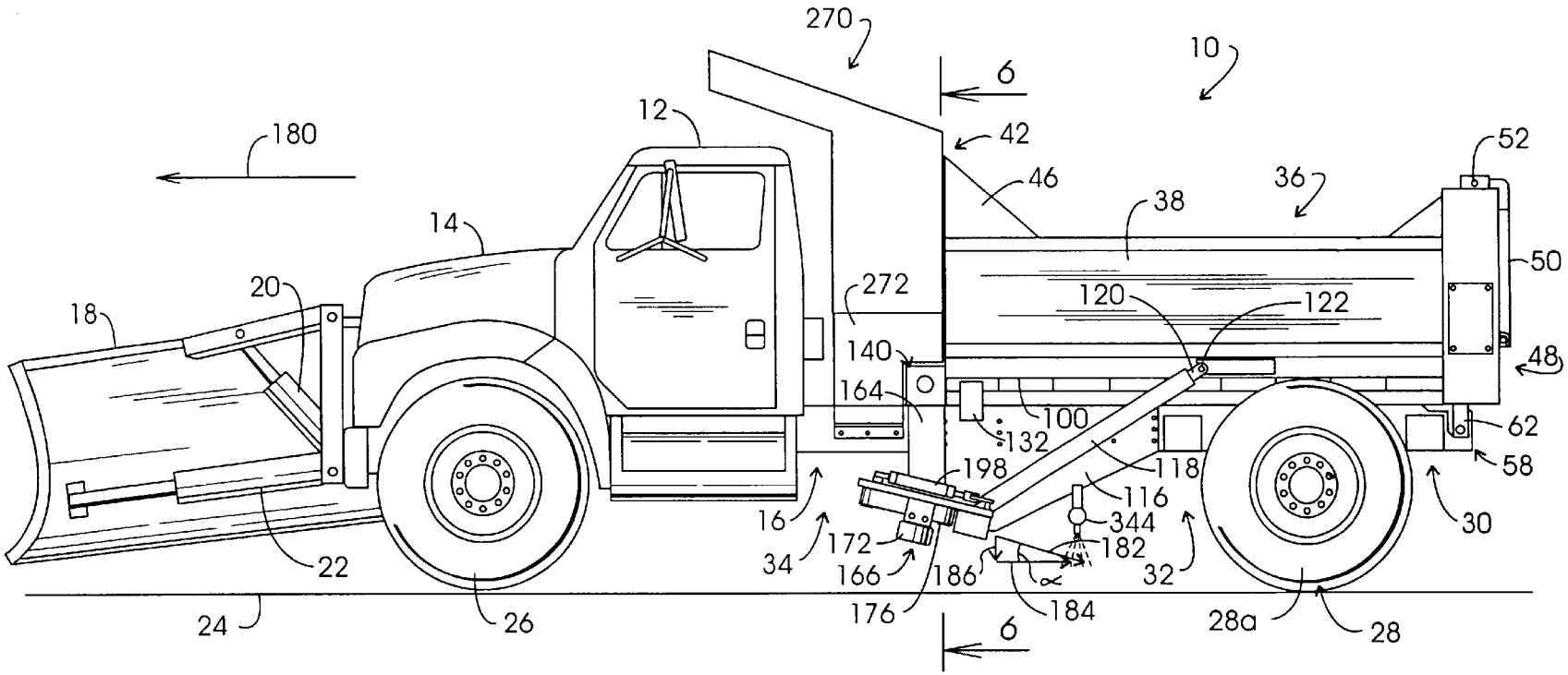
FIG. 1 is a left side elevational view of a truck outfitted with the apparatus carrying out the method of the invention.

Referring to FIG. 1, a utility vehicle which may be employed both for the seasonal duties of snow-ice removal as well as other truck based endeavors not related to snow-ice control is revealed generally at 10. Configured as a dump truck, vehicle 10 includes a cab 12 and hood 14, which protects and provides access to an engine (not shown). These components are mounted upon a frame represented generally at 16. At the forward end of the vehicle 10 there is mounted a front snowplow 18 which is elevationally maneuvered by up-down hydraulic cylinder assembly 20. Additonally, front plow 18 is laterally, angularly adjusted by left-and right-side hydraulic cylinder assemblies, the left side one of which is represented at 22. Not shown In the figure is a wing plow which is mounted adjacent the right or left fender of the vehicle 10, and which functions generally as an extension of the front plow 18, serving to push snow off of a shoulder. Truck 10 is supported on the highway pavement 24 by forwardly disposed, spaced apart wheels, the front left wheel being shown at 26 and the corresponding left rearward wheel assembly being represented in general at 28. FIG. 3 reveals a right forward wheel at 27 and a rearward wheel assembly represented generally at 29. FIG. 4 reveals that the rearward wheel assemblies 28 and 29 are of a tandem variety, assembly 28 being composed of wheels 28a and 28b and assembly 29 being formed of wheels 29*a* and 29*b*. The latter figure also reveals the rearward region of frame 16 which is located adjacent the rearward wheel assemblies 28 and 29. Frame 16 incorporates a support portion or support region represented generally at 32 In FIGS. 1–3 which extends from the frame rearward region to a forward frame region 34 located just behind or. adjacent to the cab 12. A dump bed represented generally at 36 is supported on support portion 32. Bed 36 includes oppositely disposed sides seen in the FIGS. 1 and 3 respectively at 38 and 40. The forward end of the bed 36 is represented generally at 42 and is seen to extend above the sides 38 and 40. Support for this extension is provided by triangular gussets 44 and 46 extending respectively from the tops of sides 38 and 40.

The rearward end of the bed 36 is represented generally at 48. As shown particularly in connection with FIGS. 2 and 4, rearward end 48 is configured with a somewhat conventional tailgate pivotally extending from hinges 52 and 54 and is retained in a closed orientation shown in FIG. 4 by pneumatically actuated latching assemblies 54 and 56. FIG. 4 additionally shows a pivot assembly represented generally at 58 about which the bed 36 is pivoted when raised or lowered. Assembly 58 includes a cross bar 60 which extends through the rear region 30 of frame 16 as well as through hinge brackets attached to the bottom of bed 36 and shown at 62 and 64.

Figure 4:
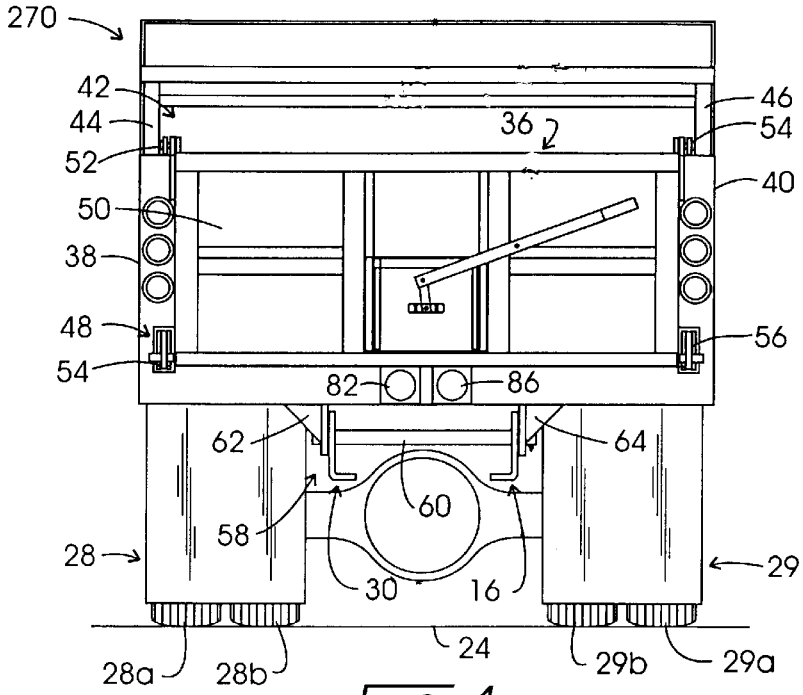
FIG. 4 is a rear elevational view of the truck of FIG. 1.
Figure 5:
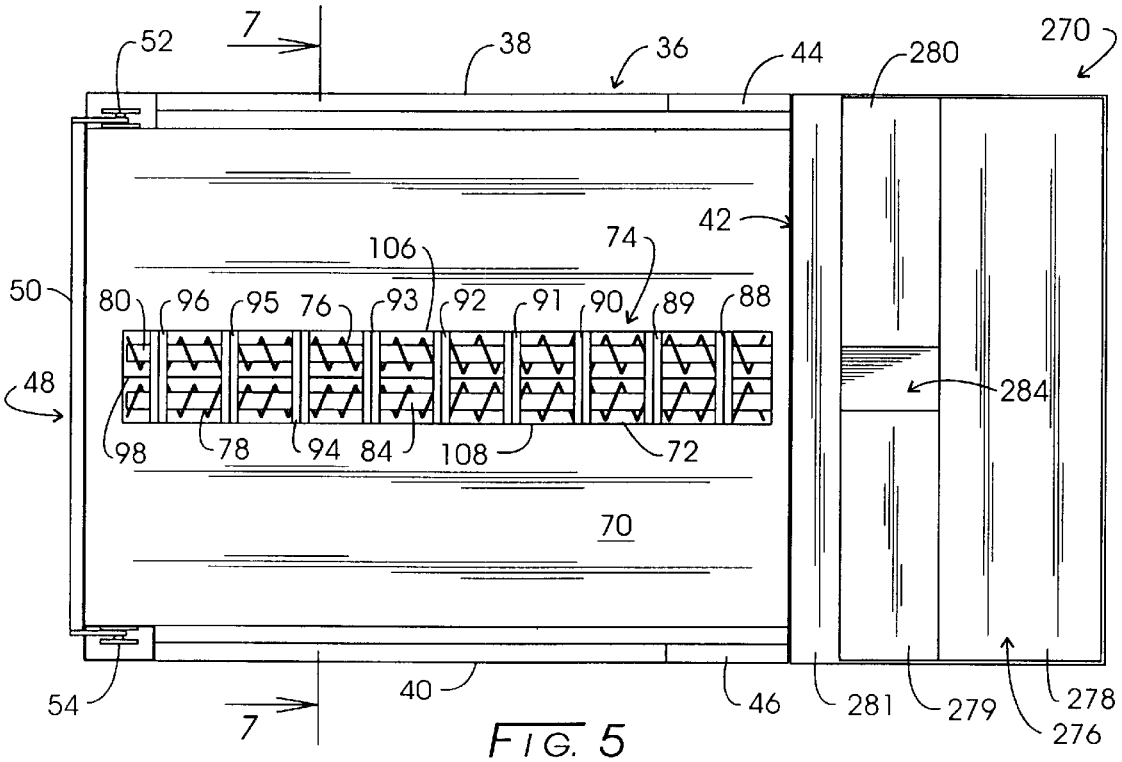
FIG. 5 is a partial top view of the truck of FIG. 1.

FIG. 5 reveals that the bottom surface 70 of the dump bed extends inwardly from sides 38 and 40 to an upwardly open elongate receiving channel 72. Channel 72, in general, extends along the center of the dump bed 36 and is of a generally rectangular configuration. Channel 72 supports a bed transport mechanism represented generally at 74 forming a portion of a material transport system mounted with the truck 10. The transport mechanism 74 is implemented with two elongate augers 76 and 78. The flights or blades of auger 76 are seen to be mounted upon a cylindrical rod or axle 80 which extends from a journaled connection with a bushing mount (not shown) adjacent front end 42 and, as seen in FIG. 4, is connected to a discrete, dedicated hydraulic motor 82 which is mounted within the supporting frame of dump bed 36. In similar fashion, the flights or blades of auger 78 are mounted upon a rod or axle 84 which is journaled for rotation within a bushing (not shown) at front end 42 and which extends rearwardly to driven connection with a dedicated discrete hydraulic motor seen in FIG. 4 at 86. FIG. 5 reveals a sequence of transverse support members 88–96 which not only function to reinforce the receiving channel 72 but also serve as supports for a sequence of steel cover plates which serve to enclose or cover the receiving channel 72 such that the truck 10 can be used for duties or tasks not associated with snow-ice control. Note the presence of an upstanding steel thin divider 98 extending between the augers 76 and 78. Preferably, all of the surfaces of the bed 36 and distribution device which come in contact with granular salt are formed of stainless steel. This will include the bottom surface 70, channel 72, sides 38 and 40, front end 42 and rearward end 48.

Figure 7:
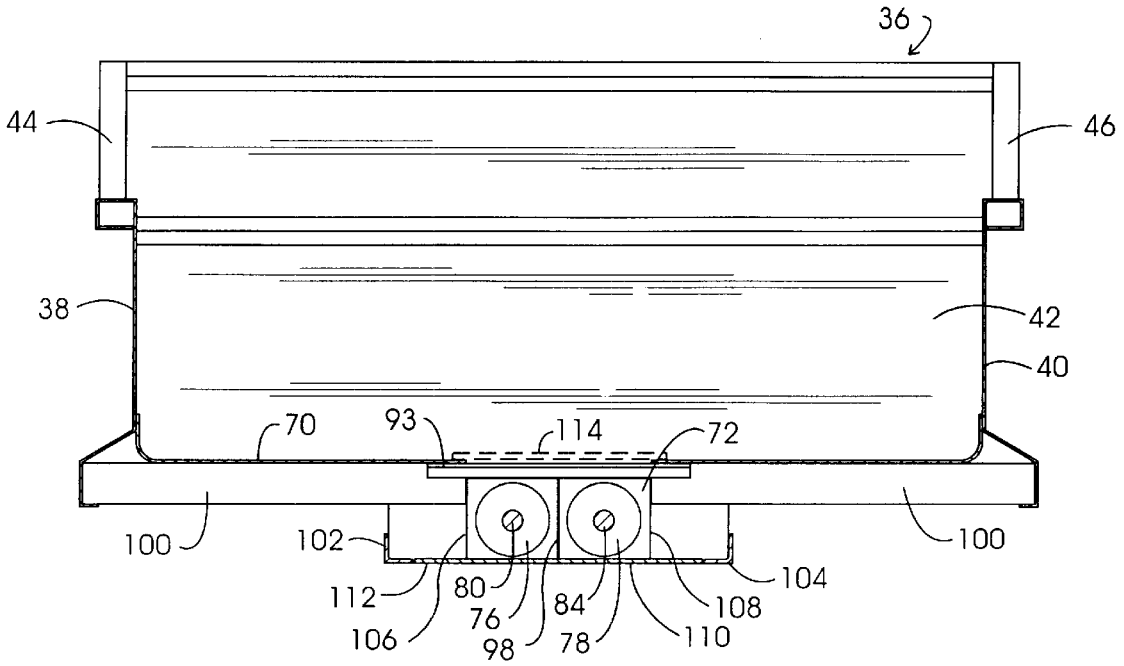
FIG. 7 is a partial sectional view taken through the plane 7—7 shown in FIG. 5.

Looking to the supporting structure of the bed 36 and its incorporated receiving channel 72 and bed transport mechanism 74, FIGS. 1–3 and 7 reveal that the stainless steel bed 36 is supported by a sequence of steel cross members certain of which are identified at 100. As seen in FIG. 7, these frame cross members 100 extend to the top of two parallel spaced apart beams 102 and 104, as well as to the sheet stainless steel sides 106 and 108 of the receiving channel 72. Sides 102 and 104 are united with a bottom portion 106 to form a secure protective stainless steel channel. The stainless steel divider 98 is seen to extend upwardly between the augers 76 and 78 and functions to promote their mutually independent salt material transport function. Located transversely between the beams 102 and 104 are a series of cross supports one of which is shown at 112 in FIG. 7. FIG. 7 also illustrates one of the earlier-described cover plates shown in phantom at 114. These cover plates 114 may be retained in position by a variety of techniques, for example, through the utilization of one or more elongate steel straps.

Figure 2:
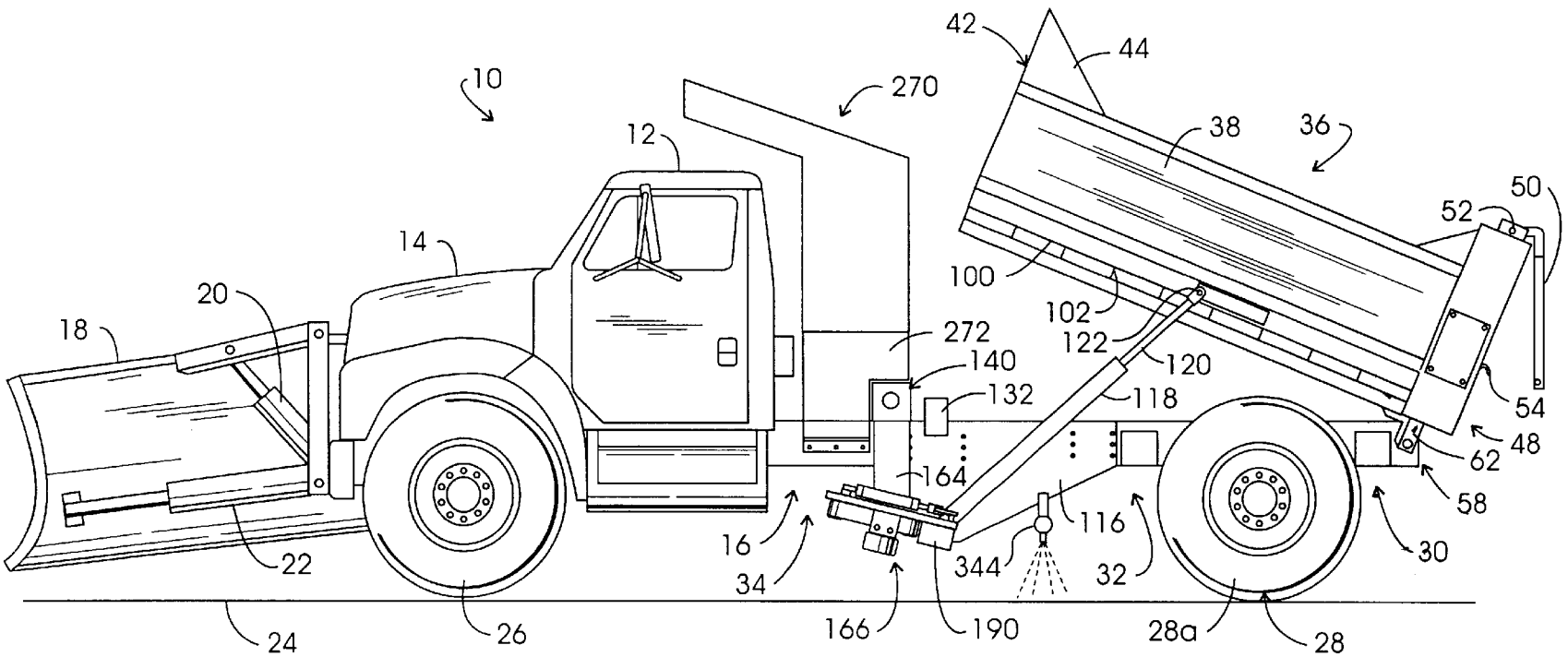
FIG. 2 is a left side elevational view of the truck of FIG. 1 showing an elevated dump bed.
Figure 3:
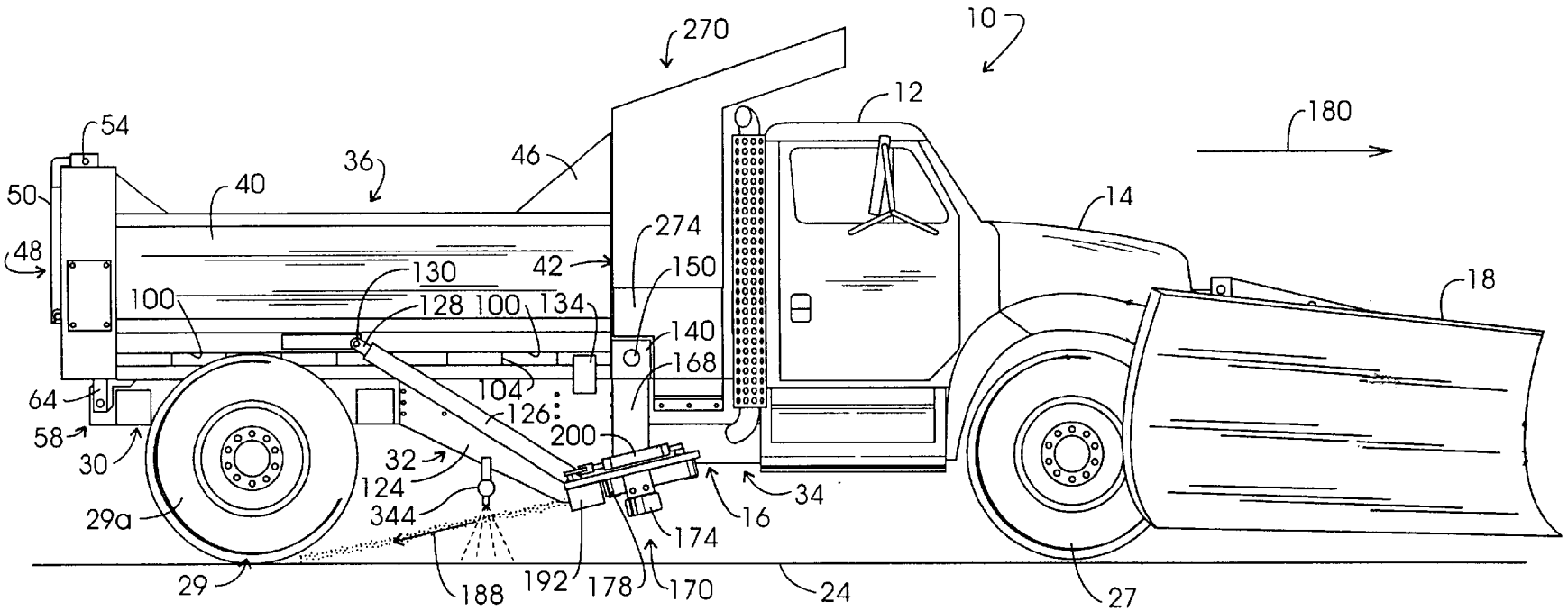
FIG. 3 is a right side elevational view of the truck of FIG. 1.

As shown in FIGS. 1–3, the elongate bed supporting beams 102 and 104, in turn, are supported by the truck frame at its support region 32. Because of the provision of the auger containing receiving channel 72, the hydraulic lift system for the dump bed 36 is modified. In this regard, as seen in FIGS. 1 and 2, a bracket 116 is bolted to the left side of the truck frame at the support region 32. This bracket 116 pivotally supports one end of a hydraulic cylinder assembly 118, the drive piston 120 of which is, in turn, pivotally coupled to the bed 36 at connection 122. FIG. 3 reveals a similar bracket 124 which is bolted to the right side of frame 16 at support region 32 and which pivotally supports the piston component of another hydraulic cylinder assembly 126, the piston component 128 of which is pivotally connected to the dump bed 36 at connection 130. To assure proper alignment of the bed support beams 102 and 104 with the frame support region 32, two upstanding guide plates as seen at 132 in FIGS. 1 and 2 and at 134 in FIG. 3 are provided. Plates 132 and 134 are connected to respective brackets 116 and 124 by a weld.

When dump bed 36 is in the down position shown in FIGS. 1 and 3, the output of the bed transport mechanism 74 is aligned with the input of a cross transport mechanism represented generally at 140 and which is supported by the vehicle 10 frame 16 at forward region 34. Looking to FIG. 6, the cross transport mechanism 140 is seen to be supported at frame forward region 34 and is shown to have a rectangular, centrally disposed input represented generally at 142 which is aligned with the sides 106 and 108 of the receiving channel 72. In the figure, the bed transport mechanism augers 76 and 78 are shown in phantom. It may be observed that the feed of granular salt from the bed transport mechanism 74 to the cross transport mechanism 140 is horizontal in nature and is divided both by virtue of the independent discrete hydraulic drives to the augers 106 and 108, as well as by virtue of the centrally disposed divider 98 also seen in phantom in FIG. 6.

Mechanism 140 is implemented as an auger structure represented generally at 144 which is mounted within an elongate housing 146 of generally rectangular configuration. Housing 146, in turn, is supported at frame forward region 34. The auger structure 144 is mounted upon an axle or rod 148 which is journaled for rotation within the left end of housing 146, and coupled in driven relationship with a hydraulic drive motor 150 at the right end of the housing. Mechanism 140 is configured such that one sequence of flights blades of the auger structure 144, as shown at 152, is configured to move granular salt delivered substantially only by auger 76 to a downwardly opening feed outlet 154. Note that on the opposite side of the feed outlet 154, a single flight of opposite material movement configuration shown at 156 is mounted upon rod 148. Flight 156 moves any material which may have bridged across the feed outlet 154 back into that outlet. Such bridging may occur, for example, inasmuch as a brine liquid is mixed with the granular salt within the flight sequence 152.

In similar fashion, a flight sequence represented generally at 158 functions to move granular salt material substantially only as it is delivered from auger 78 into downwardly disposed feed outlet 160. At the opposite side of the outlet 160, as before, a single flight 162 mounted upon rod 148, having a configuration for material movement in the reverse sense of that of flight sequence 158 is provided for the same reason as flight 156 is provided. A structurally rigid feed chute 164 is shown surmounting the feed outlet 154 and extending downwardly therefrom to supporting connection with a material ejector mechanism or accelerating apparatus represented generally at 166. Similarly, a feed chute 168 communicates in material transfer relationship between the feed outlet 160 and an ejector or accelerating mechanism represented generally at 170.

Devices 166 and 170 are configured as described in the above-noted U.S. Pat. No. 5,988,535. Each of these ejectors 166 and 170 contain a vaned impeller driven by a hydraulic motor. Such hydraulic motors for devices 166 and 170 are shown, respectively, at 172 and 174. Devices 166 and 170 and thus their respective outputs at 176 and 178 are mounted such that the salt-based material which is ejected from them is expelled downwardly and at an acute angle.

Returning to FIG. 1, the forward direction and velocity of the truck or vehicle 10 is represented by an arrow 180 which extends in parallel with the plane defined by highway 24. Material expelled, for example, from left side device 166 will travel in an opposite direction and downwardly at the acute angle, $\alpha$, as represented by a vector 182. The ejection direction represented by vector 182 will have a velocity and direction vector component corresponding with the vehicle forward direction but in a reverse directional sense, as represented at vector 184 which is seen to be parallel with the plane represented at highway surface 24. A downward vector component represented at 186 also will be evolved. The result of this combination of direction and speed of material ejection is to effect a deposition of the salt material upon highway 24 as a continuous pile of material appearing as a narrow band. This deposition occurs forwardly and in confronting relationship with the rearwardly disposed wheel assembly 28. To provide this positioning, the outlet, for example at 176 of ejection mechanism 166 is aligned to position the narrow band deposition of salt granules intermediate tandem wheels 28*a* and 28*b* (FIG. 4). FIG. 3 reveals an arrow 188 extending from the outlet 178 of device 170. Arrow 188 points to the position at pavement 24 where the narrow band deposition occurs with truck or vehicle 10 in motion, for example at speeds above about 40 mph The wheel assembly as at 29 will compact the granular salt particles within the deposited narrow band into the ice laden surface of highway 24 to enhance the development of a brine with a high salt concentration which is called for to break the Ice-pavement bond. A second advantage accrues with this arrangement. For example, where truck 10 encounters an ice covered rising grade of highway, both augers 76 and 78 may be driven to provide good granular salt based traction to wheel assemblies 28 and 29. Backing the truck uphill to gain some modicum of traction with a conventional spinner no longer is required.

Preferably, the acute angle, $\alpha$, is about 15°. A relatively "sharp" angle to the pavement p Looking to FIGS. 1–3 and 6, it may be observed that deflector baffles or plates 190 and 192 extends downwardly from the canted platforms 194 and 196 of respective ejector mechanisms 166 and 170. These platforms 194 and 196 are weldably connected to the respective chutes 164 and 168. Baffles 190 and 192 are actuated by respective hydraulic assemblies 198 and 200 into a position transversely diverting granular salt material expressed from the outlets 176 and 178 to provide a broad spreading of the salt, as opposed to the normally developed narrow band of salt material.

Looking to FIG. 8, the material accelerating apparatus or ejector represented generally at 166 in the earlier figures is illustrated in more detail. Corresponding ejector mechanism 170 is of the same configuration but represents a mirror image of the mechanism 166. In the figure, top plate or platform 194 reappears along with hydraulic motor 172. The device includes supportive side members 210 and 212 and a bottom plate member 214. Extending downwardly from the periphery of the annular input 216 through which granular salt which may be mixed with brine, is introduced is a half cylindrical timing chute 218. Chute 218 introduces the granular salt material to an impeller represented generally at 220. Looking additionally to FIG. 9, the impeller 2 is seen to be mounted upon the shaft 222 of hydraulic motor 172. In this regard, three nut and bolt assemblies 224 extend from a collar 226 fixed to shaft 222 to securement with a lower disposed receiving surface 228 of the impeller 220. Receiving surface 228 has a circular periphery and is positioned beneath an upper surface 2 of similar configuration. FIG. 9 reveals a plurality of material engaging vanes, certain of which are identified at 232, which are fixed to the receiving surface 228 and extend upwardly therefrom. Note that the vanes are canted at an angle of about 45° with respect to a radius (not shown) extending from the axis 234 of impeller to its outer periphery. An upstanding endless belt represented generally at 236 and shown in FIG. 9 is seen to have a surface positioned in abutting adjacency with the impeller circular outer periphery 238 and extends about five freely rotating cylindrical pulleys 240–244. Note that pulleys 240 and 244 provide spaced apart loop portions identified, respectively, at 246 and 248 which function to define output 176 and contribute to produce the noted narrow band deposition represented at arrow 250. Arrow 250 corresponds with arrow 188 described in conjunction with FIG. 3. In operation, granular salt, which preferably is wetted with brine, moves through the input 216 (FIG. 8) and thence into the timing chute 218 to exit from a delivery opening 252 formed therein extending upwardly from the receiving surface 228. By centrifugal force, the granular material is drawn to the outer circular periphery of the Impeller 220. As the material reaches this outer periphery, which is defined by the endless belt portion 238, it ultimately exits from the output 176 to produce the narrow band accumulation of material upon the highway. In the implementation shown, it has been found beneficial to alter the orientation of the delivery opening or window 252. In this regard, normally, the extent of the opening 252 represents a half cylinder timing chute 218. It has been found beneficial to, in effect, index or rotate this opening in a clockwise sense with respect to FIG. 9 by a small angle of about 15° from alignment with the direction of arrow 260. This affords the material being ejected more time to migrate to the outer circular periphery of the impeller before being ejected, The angle Is represented in FIG. 9 as angle, $\beta$. Pulleys 240–244 are connected to the platform or top plate 194 by threaded connections, two of which are revealed in FIG. 8 at 254 and 256. The direction of rotation of the belt at region 238 is shown in FIG. 9 at arrows 258. FIG. 9 also reveals the location of the diverter baffle or deflector 190. Note that it has a curved profile and when actuated to the position shown at 190', will divert at least a portion of the granular material or ejectate expelled from the apparatus 176 laterally with respect to arrow 250. The structuring of pulleys 240–244 and the tensioning adjustments and tracking adjustments of them with respect to the endless belt 236 are described in the above-noted U.S. Pat. No. 5,988,535.

It may be observed in conjunction with FIG. 7 that the bottom surface 70 of truck bed 36 is flat In the sense that it is not configured in the nature of a hopper having surfaces which slant toward the bed transport mechanism 74. In this regard, it has been found that the vehicle operator can cause a dynamic migration of the bed carried salt material toward the bed transport mechanism by slightly raising bed 36 and causing it to drop quickly, a procedure sometimes referred to as "down fast". Accordingly, the flat bottom surface 70 is ideally suited for vehicle utilization in tasks other than snow-ice control.

Figure 6:
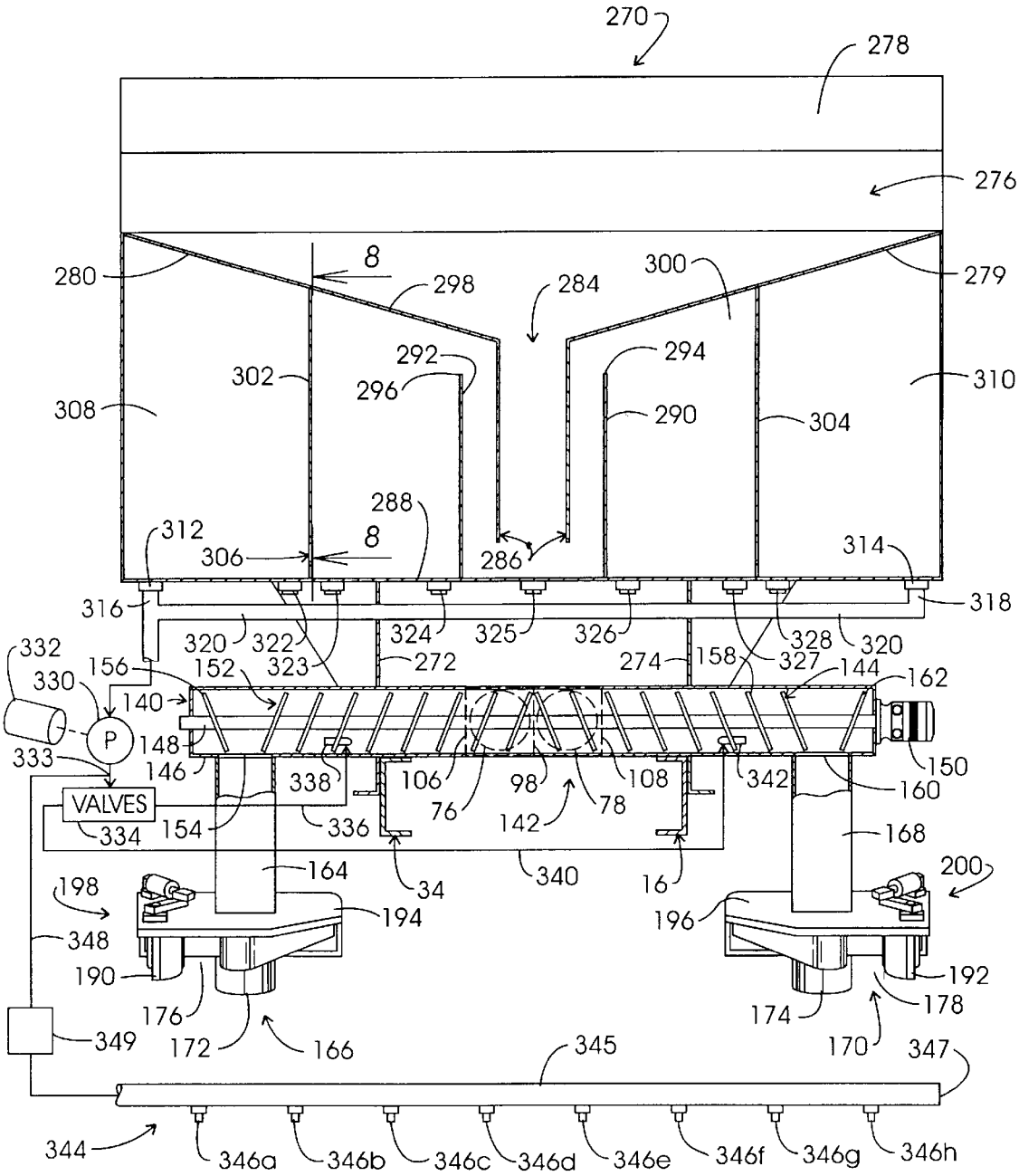
FIG. 6 is a partial sectional view taken through the plane 6—6 shown in FIG. 1.
Figure 10:
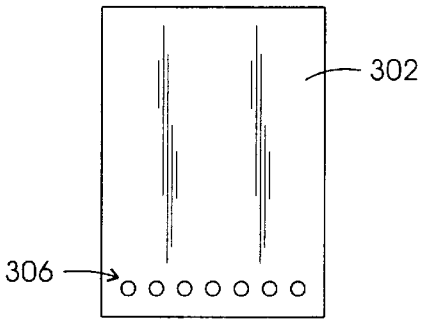
FIG. 10 is a plane view of a baffle employed with a brine formation and dispensing assembly.

Improved ice removal performance has been observed when the granular salt material is combined or wetted with a brine solution, for example, calcium chloride brine or sodium chloride brine. Savings in personnel time and cost may be realized by forming this brine solution in situ, i.e., on the vehicle 10 itself. Accordingly, a brine formation and dispensing assembly represented generally at 270 is supported from the frame 16 at forward region 34 in adjacency with cab 12. Looking to FIGS. 1–3, the assembly 270 is mounted upon upstanding brackets 272 and 274 which, in turn, are bolted to the frame 16 forward region 34. FIGS. 5 and 6 reveal that the assembly 270 comprises an upwardly open receiving chamber assembly 276 which has hopper defining upwardly facing sides 278–281 which function to cause loose granular salt to migrate to a downwardly directed feed chute 284. Chute 284 extends to a level represented at 286 (FIG. 6) located a distance above the bottom surface 288 of assembly 270. A receiving chamber component is established by two sheet metal dams 290 and 292 which extend upwardly about the feed chute 284 to elevations represented respectively at 294 and 296. In general, this receiving chamber is filled with water and a front end loader is utilized to deposit the granular salt material into the chamber 276. Loading with a front end loader is facilitated by the extension of the upper assembly over the cab 12 as seen in FIGS. 1–3. This both protects the cab 12 and minimizes the amount of frame 16 space which is required for this brine formation and dispensing function. The concentrated brine thus formed flows over the dams 290 and 292 as water is added to the chamber assembly 276 whereupon it enters a brine receiving and filtering chamber assembly provided as chambers 298 and 300. Chamber assemblies 298 and 300, thus function to assure that no particulate salt material remains in the concentrated brine. The assemblies 298 and 300 are defined at their outboard locations by respective baffles 302 and 304. Baffles 302 and 304 are identically structured. Looking momentarily to FIG. 10, baffle 302 is fabricated of stainless steel and is formed with a sequence of apertures represented generally at 306 through which the brine fluid may pass. Accordingly, turning to FIG. 6, the concentrated brine passes through the sequence of holes as at 306 to enter oppositely disposed brine holding chamber assemblies 308 and 310. It is from these tanks or assemblies 308 and 310 that the brine is distributed to the cross transport mechanism 140 for mixing with granular salt. Assemblies or tanks 308 and 310 are shown having respective output ports 312 and 314. Ports 312 and 314 are in mutual fluid communication by virtue of a conduit arrangement including pipe 316 extending from port 312 and pipe 318 extending from port 314. These pipes 316 and 318 are joined together in fluid communication by a flexible conduit or hose 320. Access to the chambers additionally is provided by a sequence of seven clean-out plugs 322–328 extending through the bottom surface 288.

The brine pumping and distribution components of the assembly 270 are shown in FIG. 6 in schematic fashion. In this regard, the conduit or pipe 316 is seen to direct brine from ports 312 and 314 into a brine pump 330 which is driven by a hydraulic motor 332. The thus pressurized brine is directed as represented at arrow 333 through a valve function represented at block 334. Valve function 334 performs in conjunction with the operator selection of either or both bed transport mechanism augers 76 and 78. Where auger 76 is driven, then as represented by arrow 336, brine is pumped through an orifice 338 into the auger flight sequence 152. Correspondingly, where the operator causes the actuation of auger 78, then brine is pumped into the cross auger flight sequence 158 as represented by arrow 340 and orifice 342. Accordingly, advantage is taken of the thorough mixing of brine liquid with granular salt, using the noted cross auger flights for this purpose.

FIG. 6 also schematically reveals a spray bar assembly represented generally at 344 which is configured generally as an elongate pipe 345 having eight fluid outlets 346*a*–346*h* and a capped end 347. Assembly 344 receives liquid brine from the pressure outlet of pump 330 at arrow 333. This liquid under pressure is directed as represented at arrow 348 to the input of pipe 345 and through a sequence valve represented at block 349. Valve 349 is actuated to open when the valve function 334 is in an off condition and the pump 330 is operating to apply liquid brine under pressure to the conduit represented by arrow 348.

The assembly 344 is utilized for the specific purpose of depositing liquid brine upon bridge decks when those decks are in a dry condition just prior to the commencement of inclement weather which otherwise would cause an early formation of ice. In general, motorist in the northern regions are familiar with warning signs provided by highway organizations advising that bridge decks freeze, i.e., develop ice coatings, before the general roadways. By dispatching the vehicles to bridge locations just prior to the commencement of inclement weather, the formation of ice on the bridge decks can be substantially retarded.

FIGS. 1 and 3 reveal that the spray bar assembly 344 is supported from the frame of vehicle 10 in an orientation generally transversely to its centerline, i.e., its forward direction. The fluid outlets are generally downwardly directed to provide a spray activity schematically represented in FIG. 3.

Figure 11:
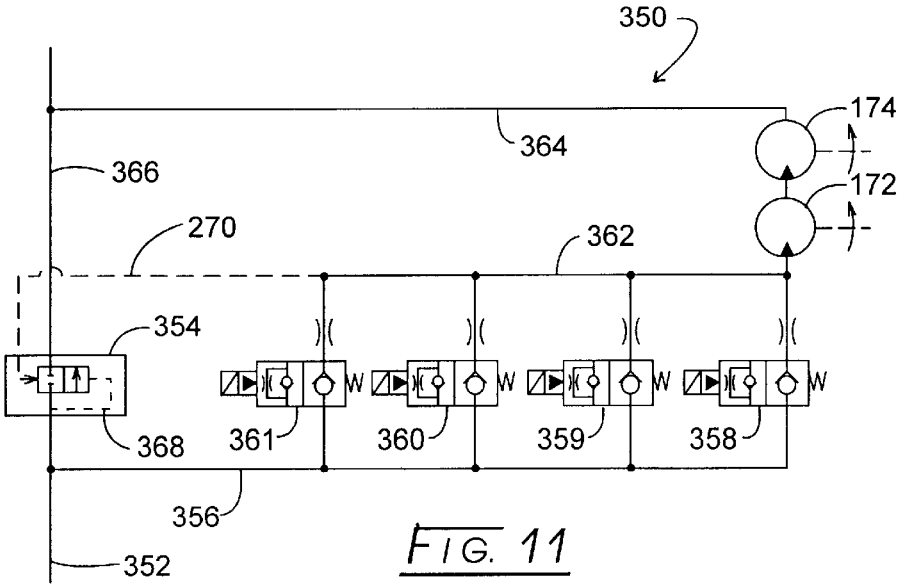
FIG. 11 is a schematic hydraulic circuit diagram showing that portion of the hydraulic system of the truck of FIG. 1 employed for driving hydraulic motors.

As described in detail in the above-noted U.S. Pat. No. Re. 33,835, the hydraulic circuit employed in conjunction with vehicle 10 is in series such that the flow from a pump function first satisfies the requirement of the hydraulic motors and actuators of devices 166 and 170. In this regard, the entire flow from the pump function may be made available to motors 172 and 174 and then may be made available for the remainder of functions including those of the vehicle 10, i.e., the plow 18 as well as other places and bed hoist function. Pressures for each such function are additive and the peak pressure for the series circuit is higher than for corresponding parallel circuits. Typical pressures for the bed and cross transport augers is 300–500 psi and the pressure for motors 166 and 170 usually is under 2000 psi. With the series arrangement, no horsepower is wasted with respect to the primary engine of vehicle 10 in providing pump capacity for the bed and plow when they are not in use. This represents an advantage, for example, when compared with parallel systems. Looking to FIG. 11, the components of this series hydraulic system employed for driving hydraulic motors as at 172 and 174 are schematically portrayed in general as hydraulic network 350. Network 350 is coupled to a principal or main hydraulic line 352. Line 352 is seen to extend both to a hydraulically actuated by-pass valve 354 and to a line 356 extending, in turn, to one side of a grouping of four, speed-controlling solenoid valves 358–361. The opposite sides of valves 358–361 extend to line 362 which, in turn, extends to line 364 containing motors such as those described at 172 and 174 and represented in the figure in symbolic fashion with the same numeration. Line 364 is seen to return to line 366 on the opposite side of by-pass valve 354. The activity of valve grouping 358–361 is monitored by pilot lines as represented at 368 and 370 to effect appropriate bi-pass pressure compensation of valve 354. To provide for binary speed control, valves 58–361 may each be assigned one value in a sequence of binary numbers, for example, $2^0$–$2^3$. Three such binary valve arrays as at 350 are employed for controlling the brine pump hydraulic motor 332, the "zero velocity" motors 172 and 174, and the bed augers and cross auger.

Figure 12:
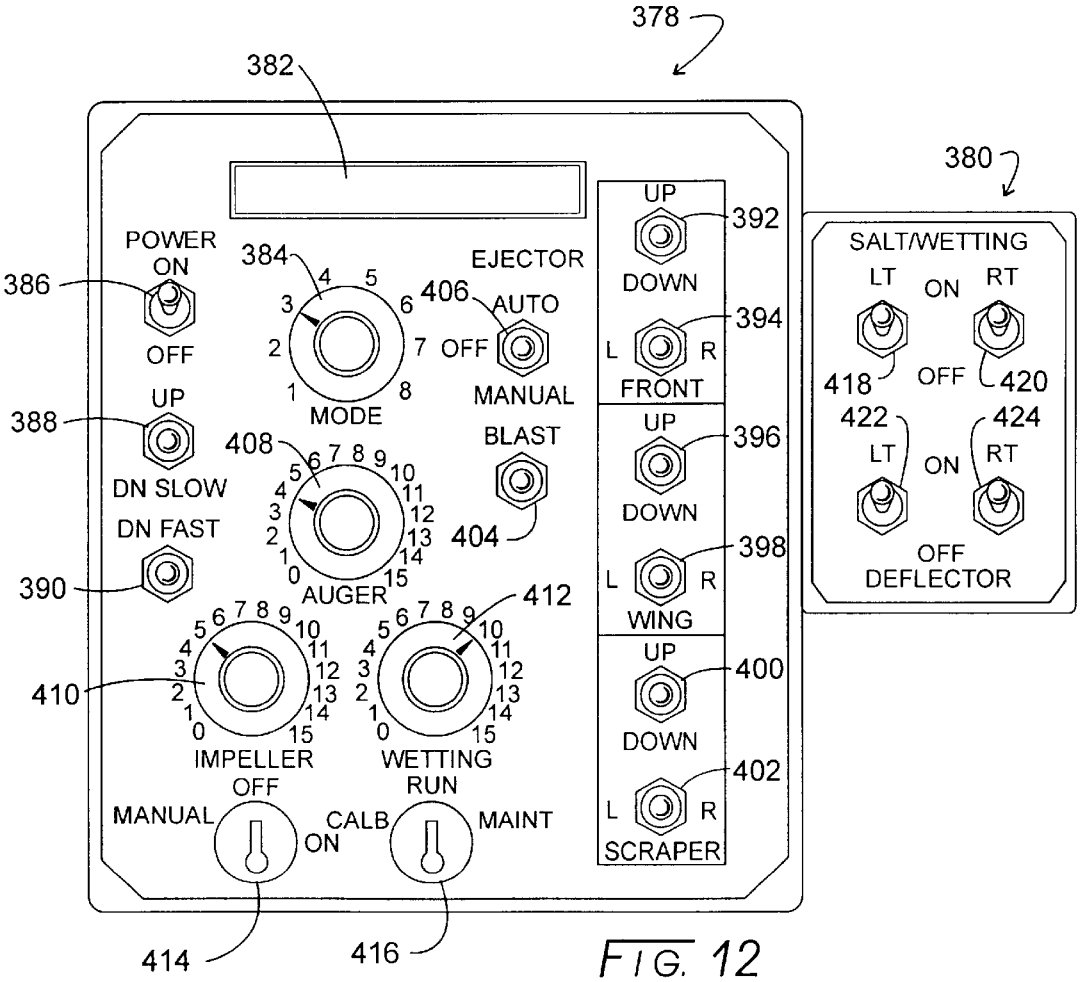
FIG. 12 is a front view of the panels of a control box and an auxiliary control box which may be employed with the invention.

Control over the hydraulic systems employed with vehicle 10, as well as the narrow band salt material deposition system of the invention is provided by a microprocessor-driven circuit. Supporting electronic components for control over the system are retained within the cab 12 of the vehicle 10 and, preferably, within a tamper-proof and environmentally secure console or control box which is monitored at a location for convenient access by the operator. The user interfacing front of such a control box as well as an auxiliary box is illustrated in connection with FIG. 12. Referring to FIG. 12, the faces of the control box or console and associated auxiliary box are represented in general respectively at 378 and 380. Positioned at the forward face 378 is an LCD display 382 providing for readouts to the operator depending upon the positioning of a mode switch 384. Switch 384 is movable to any of eight positions from one to eight providing, respectively: speed of vehicle 10 in miles per hour; the deposition of material rate in pounds per mile; day and time; distance measured in feet from a stop position; distance measured from a stop position in miles; a data logging option; temperature of hydraulic fluid; and pressure of hydraulic fluid. Main power is controlled from switch 386 and the movement of the bed 36 up and down normally or slowly is controlled from switch 388. Correspondingly, a fast down movement of bed 36 can be controlled from switch 390. Recall that this feature functions to cause a dynamic movement of granular salt within the bed 36 toward the bed transport mechanism 74. In general, the truck is stopped, the augers deactivated and the bed is raised and then dropped rapidly to agitate the bed carried granular salt material. Control over the main plow or front plow 18 in terms of elevation is provided at switch 392, while left-right or plow angle control is provided from switch 394. Correspondingly, control over a wing plow in terms of elevation is provided from switch 396 and a right-left directional control is provided from switch 398. Elevational control of a scraper plow is provided from switch 400, while a corresponding left-right orientation of the scraper plow is controlled from switch 402. Auger blast actuation is developed at switch 404. This function provides for essentially maximum rotational speed of the bed retained and cross augers. The selection of either a fully automatic salt dispensing function or a manual salt dispensing function is elected by actuation of toggle switch 406. Additionally, the switch 406. has an orientation for turning off the auger distribution function. When this switch is in an automatic orientation, the amount of snow-ice material is controlled automatically with respect to the speed of vehicle 10 and predetermined inserted data as to, for example, poundage per mile. When in a manual operational mode, the rate of material output is set by the operator. In electing these amounts, for example, an auger switch 408 may be positioned at any of sixteen detent orientations for selecting the quantity of material deposited. When the system is in automatic mode as elected at switch 406, switch 408 selects the material application in pounds per mile, adjusting the hydraulic control system automatically with respect to vehicle speed. The control of the speed of the impellers is provided manually by the sixteen position switch 410. When switch 406 is in an automatic mode and the impeller switch 410 is in its sixteenth position, the speed of the ejector motors is automatically elected with respect to vehicle speed. Thus to evoke the operation of the instant invention, switch 410 is set to its last position or number and switch 406 is set for an automatic mode of ejector control. Control over the motor 332 driving the brine pump 3is provided from switch 412. Two additional switches are provided at the console face plate 378 and these switches are key-actuated for security purposes. The first such switch as at 414 provides a manual lock-out function wherein the operator is not able to operate the system on a manual basis and must operate it on an automatic basis. Correspondingly, switch 416 moves the control system into a calibrate/maintenance mode.

The auxiliary console faceplate 380 provides operator election of a combined salt ejection and brine wetting control over valve function 334. In this regard, toggle switch 418 provides for drive of bed auger 76 and the dispensing of fluid brine as represented at arrow 336. Selective actuation of toggle switch 4provides for corresponding drive to bed auger 78 and the dispensing of brine as represented at arrow 340. The left deflector or baffle 190 is actuated from hydraulic assembly 198 by operator use of toggle switch 422, while corresponding actuation of the right deflector or baffle 192 from hydraulic assembly 200 is carried out by actuating toggle switch 424.

Operator actuation of the sequence valve 349 of the spray bar assembly 344 described in connection with FIG. 6 is carried out when the vehicle 10 is moving over an ice-free bridge deck just prior to the onset of inclement weather otherwise creating an ice covering. Liquid brine is expelled upon that now dry but ice jeopardized deck by turning off switches 418 and 420 thus close off the valve function represented at block 334 in FIG. 6. Additionally, the wetting switch 412 is turned on to activate the pump 3 and motor 332 combination to create liquid brine pressure at delivery conduits represented at arrows 333 and 348 and to, in consequence, cause the opening of the sequence valve function 349.

Depositing, for example, a 23% solution of salt brine on a clear, i.e., ice-free bridge deck prior to or in anticipation of the formation of ice on the deck provides an anti-icing function. In this regard, the brine tends to remain on the bridge deck, for example, migrating into deck surface pours and is observed to have a tendency to remain on the deck for a period ranging from hours to days, depending upon the level of traffic over the bridge deck. Because of the solution concentration involved, the deposition is somewhat environmentally friendly and problems arising from the combination of high-speed traffic and granular salt brine particles on dry highway are avoided. In general, a deposition of granular salt on the bridge decks at this ice-clear point of time results in a traffic disbursement of material which is relatively undesirable as compared with the deposition of brine. Following the deposition of the brine on the deck, subsequent inclement weather ice formation is initially controlled by the anti-icing activity of the brine.

Figure 13:
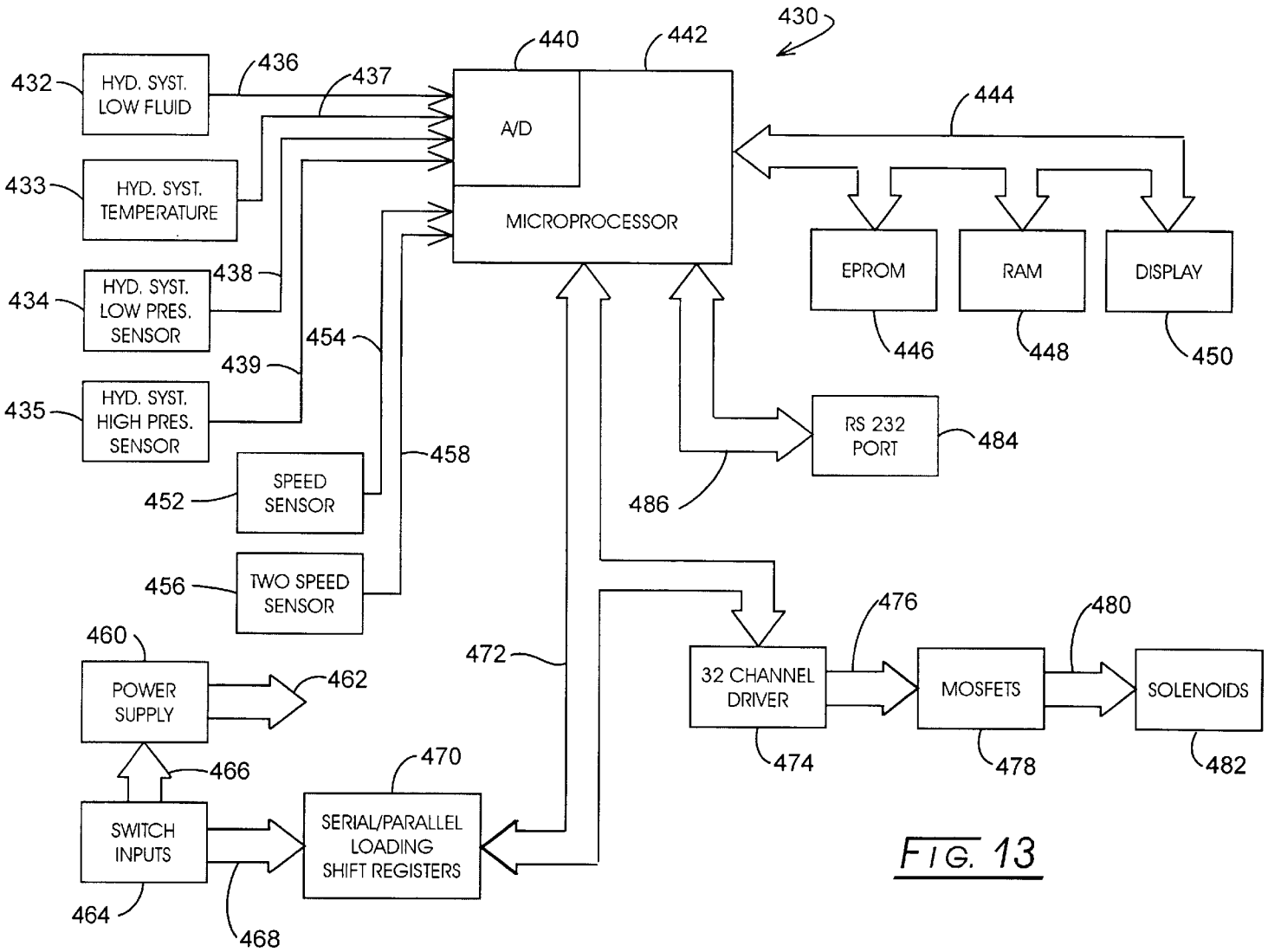
FIG. 13 is a block schematic diagram of a control circuit which may be employed with the invention.

Referring to FIG. 13, a block diagrammatic representation of a microprocessor driven control function for vehicle 10 and its associated snow/ice control features is identified generally at 430. The control function operates in conjunction with six sensor functions. In this regard, a hydraulic system low fluid sensor is provided as represented at block 432. A hydraulic system temperature sensor function is provided as represented at block 433. A hydraulic system low-pressure sensor function is provided as represented at block 434, and a hydraulic system high-pressure sensor is provided as represented at block 435. The functions represented at blocks 432–435 provides inputs as represented at respective lines 436–439 to the analog-to-digital function represented at sub-block 440 of a microprocessor represented by block 442. Microprocessor 442 may be provided as a type 68HC11 marketed by Motorola Corporation. Device 442 is a high-density complementary metal-oxide semi-conductor with an eight-bit MCU with on chip peripheral capabilities. These peripheral functions include an eight-channel analog-to-digital (A/D) converter as noted above. An asynchronous serial communication interface is provided and a separate synchronous serial peripheral interface is included. Its main, sixteen-bit, free-running timer system has three input capture lines, five output-compare lines, and a real time interrupt function. An eight-bit pulse accumulator sub-system can count external events or measure external periods. Device 442 performs in conjunction with memory (EPROM) as represented at bi-directional bus 444 and block 446. Communication also seen to be provided via bus 444 with random access memory (RAM) which may be provided, for example, as a DS 1644 non-volatile time-keeping RAM marketed by Dallas Semi-Conductor Corporation and represented at block 448. The LCD display 382 is represented at block 450. This function may be provided by a type DV-16100 S1FBLY assembly which consists of an LCD display, a CMOS driver and a CMOS LSI controller marketed by Display International of Oviedo, Fla. Digital sensor inputs to the microprocessor function 422 are provided from a speed sensor represented at block 452 in line 454, as well as a two-speed sensor function represented at block 456 and line 458.

The circuit power supply is represented at block 460. This power supply, providing two levels of power, distributes such levels where required as represented at arrow 462. The supply 460 is activated from the switch inputs as discussed in conjunction with FIG. 12 and represented in the instant figure at block 464 and arrow 466. These various console and auxiliary console switch inputs as represented at block 464 also are directed, as represented at bus 468, to serial/parallel loading shift registers as represented at block 470. As represented by bus 472, communication with the function at block 470 is provided with the microprocessor function represented at block 442. Bus 472 also is seen directed to a 32 channel driver function represented at block 474. Function 474 may be implemented with a 32 channel serial to-parallel converter with high voltage push-pull outputs marketed as a type HB9308 by Supertex, Inc. The output of the driver function represented at block 474 is directed as represented by arrow 476 to an array of metal-oxide semiconductor field effect transistors (MOSFETS) as represented at block 478. These devices may be provided as auto-protected MOSFETS type VNP10N07F1 marketed by SGS-Thomson Microelectronics, Inc. The outputs from the MOSFET array represented at block 478 are directed as represented by arrow 480 to solenoid actuators as represented at block 482. An RS232 port is provided within the control function 4as represented at block 484 and arrow 486 communicating with microprocessor function 442.

Figure 14:
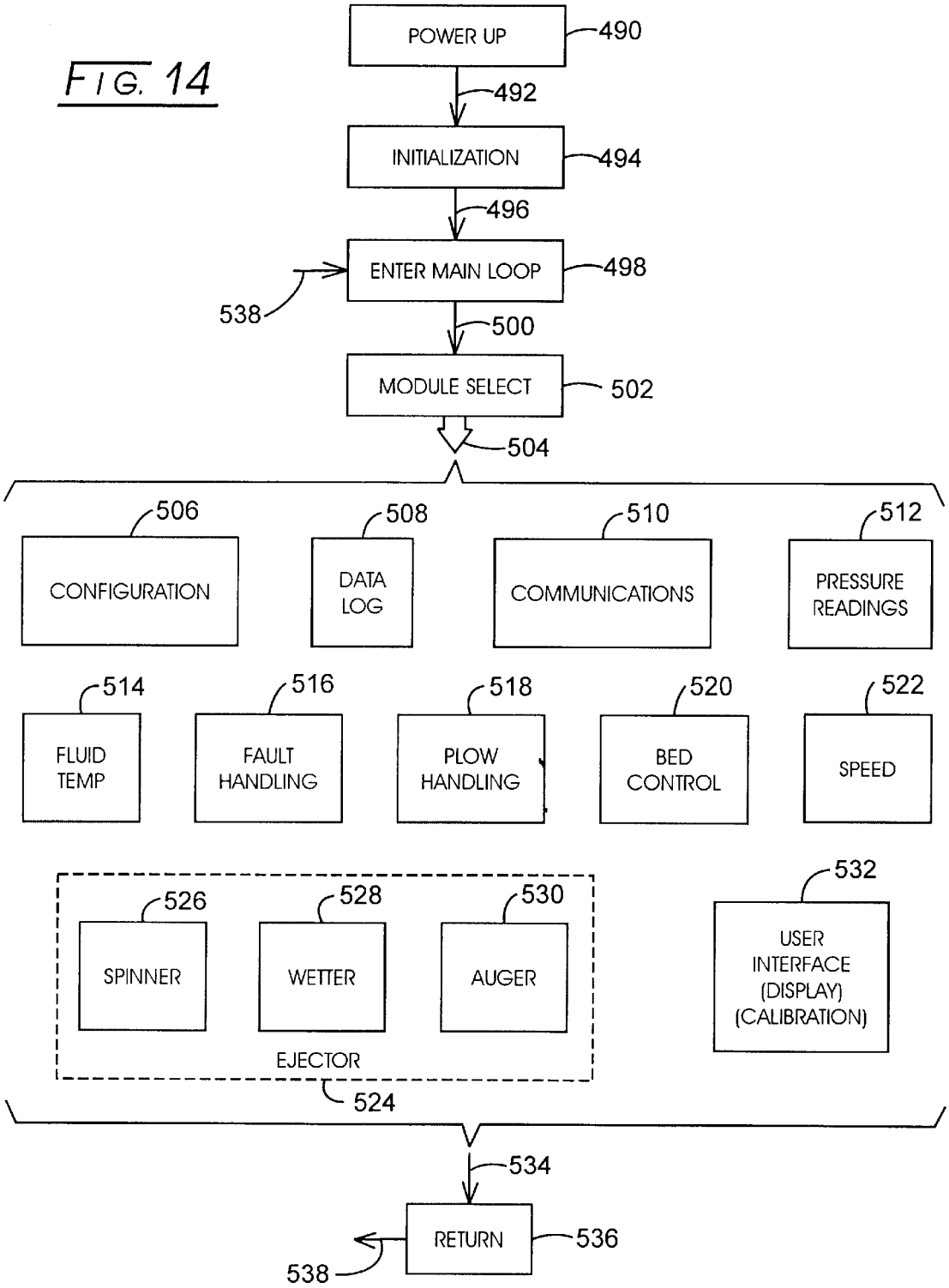
FIG. 14 is a block diagram illustrating the general control program employed with the invention.

Referring to FIG. 14, a block diagram of the program with which the microprocessor function represented at block 442 performs is set forth. As represented at block 490, the program carries out a conventional power up procedure upon the system being turned on.

Then as represented by line 492 and block 494, conventional initialization procedures are carried out. Upon completion of the initialization procedures, as represented by line 496 and block 498, the program enters into a main loop. In effect, the main loop performs in the sense of a commutator, calling a sequence of tasks or modules. Certain of those tasks are idle tasks which are activated when no other components of the program are active. Additionally, the system is somewhat event driven to the extent that it monitors random inputs as from switches and the like. Thus, as represented at line 500 and block 502, the main loop functions to select modules in a sequence and the module identification and selection is represented by arrow 504.

An initial module is represented at block 506, which provides a configuration function, particularly with respect to the entering of new data into memory when configurations change.

Block 508 represents a data log module wherein data for a given trip of the vehicle is recorded.

For example, data is collected each five seconds with respect to such functions as turning on the augers, auger speed and the like. Such information then may be read out as a record at the end of any given trip. A module providing for communication as represented at block 510 handles the function of the RS232 port. Block 512 represents a pressure reading module which carries out a sampling of hydraulic pressure at a relatively fast rate and provides a filtering in software to improve values from that. The fluid temperature module represented at block 514 periodically reads hydraulic fluid temperature and carries out software filtering of the data. Block 516 represents a fault-handling module, which looks for various fault conditions in the system and provides a two-second fault message at the LCD display 382. This module also can carry out shut down procedures under certain conditions. Block 518 describes a plow-handling module, which functions to carry out control of the front and wing plows, which may be employed with vehicle 10. A bed control module is represented at block 520, which handles the control of dump bed 36. Block 522 looks to a module, which develops distance and speed data. Dashed boundary 524 represents a composite module identified as an ejector module. In this regard, the module tracks data concerning the impeller, i.e., ejectors function performance represented at block 526. Additionally, the ejector module looks to the performance of the brine delivery pumping function as represented at block 528 and, finally, the module 524 considers the speed of the augers as driven from the auger motors. It may be recalled that these motors drive the bed augers and the cross auger. Block 532 represents a user interface module, which responds to a variety of user interface activities such as switching. It includes a sub-module for providing display outputs and for responding to calibration inputs.

When the modules have been evaluated in the main loop, then as represented at line 534 and block 536, the program returns and as represented at line 538, which reappears in conjunction with block 498, the main loop again is entered.

Figure 15:
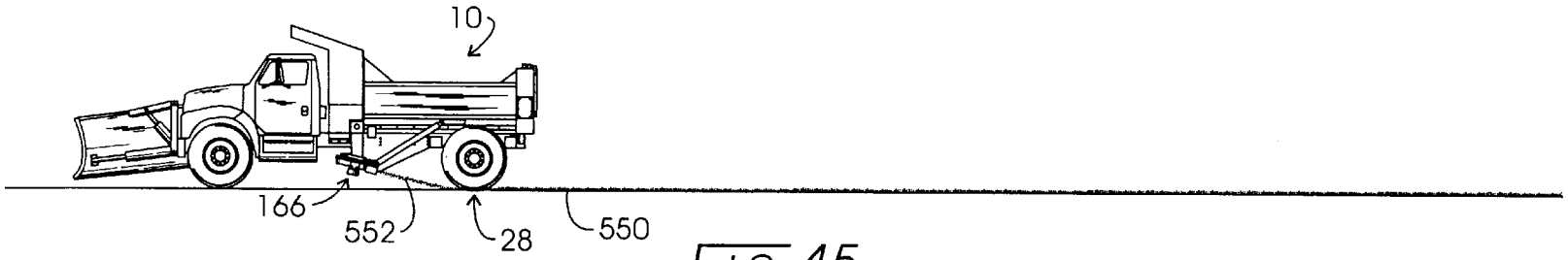
FIG. 15 is a side elevational view of a truck configured in accordance with the invention, illustrating material deposition and rear wheel assembly compaction.
Figure 16:
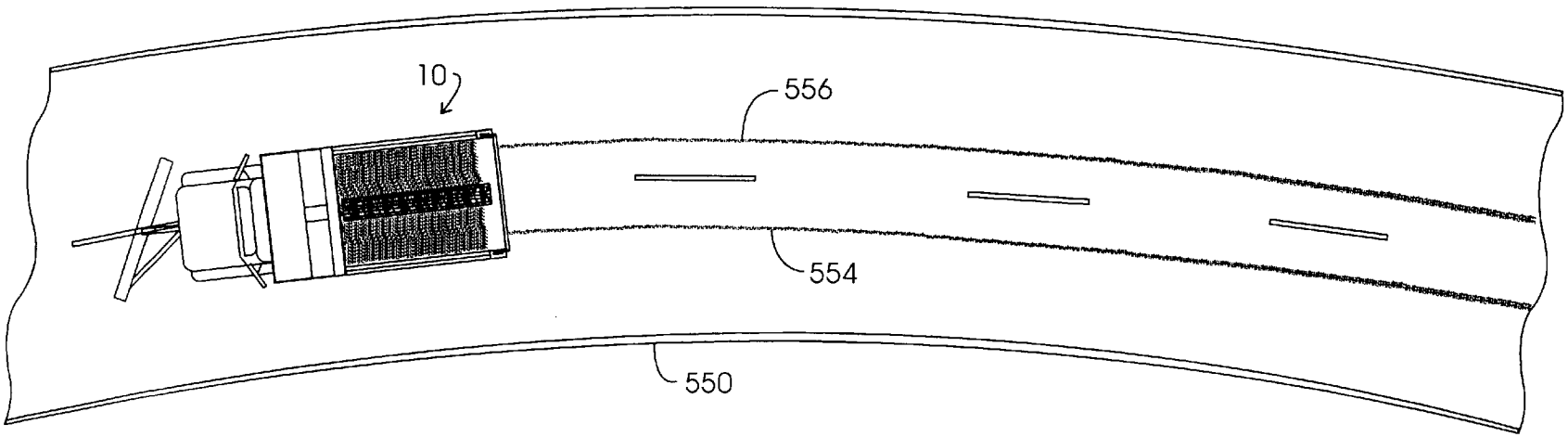
FIG. 16 is a top view of the vehicle and material deposition arrangement shown in FIG. 15 illustrating the narrow band which are evoked with the methology.

Looking to FIG. 15, the operation of the apparatus of the invention and its methodology is illustrated in a highway setting wherein two adjacent highway lanes are joined at a super-elevated center. Such a highway is represented at 550. In FIG. 15, the ejectant forms a narrow continuous band as represented at 552 initially from the ejector 166. Note that the wheel assembly 28 is compacting the ejected band of material into pavement borne ice. Because the highway 550 is illustrated as having superelevated center between two adjacent lanes, the truck 10 can straddle a portion of each lane and utilize both ejectors 166 and 170 to lay down two narrow bands of mixed brine and granular salt which is further compacted by the wheel assemblies 28 and 29. The resultant compacted narrow bands are illustrated in FIG. 16 at 554 and 556. With the arrangement shown, following a relatively short interval of time, a brine will evolve with respect to each of the narrow band depositions 554 and 556 which will exhibit a salt concentration effective to break the ice-pavement bond. Additionally, this concentrated brine solution has been observed to migrate gravitationally to cause a substantial breakup of ice which extends toward each berm.

Since certain changes may be made in the above-described method and apparatus without departing from the scope of the invention herein involved, it is intended that all matter contained in the description thereof or shown in the accompanying drawings shall be interpreted as illustrative and not in a limiting sense.

What is claimed is:

1. In a vehicle having a frame supporting forwardly disposed spaced apart wheels, an engine and a cab, spaced apart first and second rearwardly disposed wheel assemblies said frame having a support portion extending from a forward frame region adjacent said cab to a rearward frame region adjacent said first and second rearwardly disposed wheel assemblies, said vehicle being movable over a plane defining highway at a given forward velocity and forward direction, the improved apparatus for depositing granular snow-ice treatment material upon said highway, comprising:

a dump bed for receiving said material supported upon said frame support portion having oppositely disposed sides, a forward end adjacent said forward frame region, a rearward end adjacent said rearward frame region, and a bed surface extending inwardly from said oppositely disposed sides to an upwardly open receiving channel extending rearwardly from a forward location adjacent said forward end to a rearward location adjacent said rearward end;

a bed transport mechanism mounted within said receiving channel and drivable to engage said material when within said dump bed, to convey it to a transport outlet adjacent said forward end;

a cross transport mechanism supported at said forward frame region, having an input aligned with said bed transport mechanism transport outlet for receiving said material therefrom and drivable to convey said material to oppositely disposed first and second feed outlets;

a first ejector mechanism supported at said forward frame region, having a first input positioned in material receiving relationship with said first feed outlet, and a first ejector output for expelling said material downwardly at an acute angle with respect to said plane and with an ejection velocity and ejection direction effecting deposition of said expelled material upon said highway as a narrow band forwardly of and in confronting relationship with said first rearwardly disposed wheel assembly; and a second ejector mechanism supported at said forward frame region, having a second input positioned in material receiving relationship with said second feed outlet, and a second ejector output for expelling said material downwardly at an acute angle with respect to said plane and with an ejection velocity and ejection direction effecting deposition of said expelled material upon said highway as a narrow band forwardly of and in confronting relationship with said second rearwardly disposed wheel assembly.

2. The apparatus of claim 1 in which:

said ejection velocity and ejection direction of said material ejected from said first and second ejector outputs exhibits a velocity and direction vector component corresponding with said vehicle forward velocity and a direction opposite said forward direction.

3. The apparatus of claim 1 in which:

said bed transport mechanism includes a first material conveyor extending to a first portion of said transport outlet and drivable to convey said material thereto;

a second material conveyor extending to a second portion of said transport outlet and drivable to convey said material thereto; and said cross transport mechanism is configured for transporting substantially all said material conveyed to said first portion of said transport outlet to said first feed outlet and for transporting substantially all said material conveyed to said second portion of said transport outlet to said second feed outlet.

4. The apparatus of claim 3 in which:

said dump bed is actuable to pivotally move between a down position abuttably supported from said frame support portion and raised positions; and said bed transport mechanism is supported by and movable with said dump bed, and said transport outlet is generally horizontally aligned with said cross transport mechanism input when said dump bed is in said down position.

5. The apparatus of claim 3 including a control and drive assembly selectively actuable for effecting the drive only of said first material conveyor to cause said expelling of said material only from said first ejector output, actuable for effecting the drive only of said second material conveyor to cause said expelling of said material only from said second ejector output, and actuable for effecting the drive of both said first and second material conveyor to cause said expelling of said material from both said first and second ejector outputs.

6. The apparatus of claim 3 in which said cross transport mechanism comprises:

an auger assembly having a first flight sequence of first material movement configuration extending between said input adjacent said first material conveyor first portion of said transport outlet and the inwardly disposed side of said first feed outlet and having a flight of second material movement configuration opposite said first material movement configuration located at the outwardly disposed side of said first feed outlet; and said auger assembly having a second flight sequence of said second material movement configuration extending between said input adjacent said second material conveyor second portion of said transport outlet and the inwardly disposed side of said second feed outlet and having a flight of said first material movement configuration located at the outwardly disposed side of said second feed outlet.

7. The apparatus of claim 1 including a brine formation and dispensing assembly mounted at said forward frame region and having a brine dispensing outlet coupled in liquid delivering communication with said cross transport mechanism for effecting the mixing of brine with said material.

8. The apparatus of claim 7 in which said brine formation and dispensing assembly includes a spray assembly supported by said frame and generally oriented transversely with respect to said forward direction, having a plurality of downwardly directed fluid outlets and coupled in fluid transfer communication with said brine dispensing outlet and including a valve actuable to deliver brine to a generally ice free bridge deck through said fluid outlets.

9. The apparatus of claim 7 in which said brine formation and dispensing assembly comprises:

an upwardly open receiving chamber assembly having hopper defining sides configured for receiving granular salt;

a brine receiving and filtering chamber assembly in fluid communication with said receiving chamber assembly for receiving brine;

a brine holding chamber assembly in fluid transfer communication with said brine receiving and filtering chamber and having a brine output port; and a pumping and brine distribution assembly coupled with said brine output port and said cross transport mechanism.

10. The apparatus of claim 9 in which said brine formation and dispensing assembly includes a spray assembly supported by said frame and generally oriented transversely with respect to said forward direction, having a plurality of downwardly directed fluid outlets and coupled in fluid transfer communication with said pumping and brine distribution assembly and including a valve actuable to deliver brine to a generally ice free bridge deck through said fluid outlets.

11. The apparatus of claim 9 in which said upwardly open receiving chamber assembly of said brine formation and dispensing assembly extends at least partially over said vehicle cab.

12. The apparatus of claim 1 in which:

said dump bed surface is flat; and said receiving channel is located centrally within said dump bed.

13. The apparatus of claim 1 including a cover assembly removably mountable over said upwardly open receiving channel to convert said vehicle dump bed for carriage of materials and items other than said snow-ice treatment material.

14. The apparatus of claim 1 in which:

said bed transport mechanism comprises a first auger extending to a first portion of said transport outlet and having a first motor coupled in driving relationship thereto and actuable to effect its material conveying rotation;

a second auger in parallel adjacency with said first auger, extending to a second portion of said transport outlet and having a second motor coupled in driving relationship thereto and actuable to effect its material conveying rotation; and said cross transport mechanism is configured for transporting substantially all said material conveyed to said first portion of said transport outlet to said first feed outlet and for transporting substantially all said material conveyed to said second portion of said transport outlet to said second feed outlet.

15. The method of depositing granular snow/ice salt-based treatment material onto a plane defining highway from a vehicle having a frame supporting forwardly disposed, spaced apart wheels, an engine, a cab, spaced apart first and second rearwardly disposed wheel assemblies and a support portion extending from a forward frame region adjacent said cab to a rearward frame region adjacent said first and second rearwardly disposed wheel assemblies, said vehicle being movable over said highway at a given forward velocity and forward direction, comprising the steps of:

providing a quantity of said treatment material for transport with said vehicle;

providing a transport mechanism mounted upon said vehicle for delivering said material to first and second spaced apart outlets at said forward frame region;

providing a first material accelerating apparatus with said vehicle at said forward frame region, having a first input for receiving said material from said first outlet and a first output for expelling said material with an ejection velocity and ejection direction effecting deposition of said expelled material at a location upon said highway in confronting relationship with said first rearward wheel assembly;

providing a second material accelerating apparatus with said vehicle at said forward frame region, having a second input for receiving said material from said second outlet and a second output for expelling said material with an ejection velocity and ejection direction effecting deposition of said expelled material at a location upon said highway in confronting relationship with said second rearward wheel assembly; and expressing said material from selected said first and second outputs, said ejection velocity and direction having a velocity vector component substantially parallel with said plane of value corresponding with the value of said vehicle given velocity and a direction substantially opposite said vehicle direction, said material being expressed from said first and second outputs in a manner depositing said material on said highway as respective first and second bands each being formed forwardly of respective said first and second rearward wheel assemblies as a compact narrow continuous pile of material evoking a brine formation which maintains a salt concentration effective to break an ice-pavement bond.

16. The method of claim including the step of:

compacting said first and second bands against said highway by driving respective said first and second rearward wheel assemblies over them.

17. The method of claim including the steps of:

providing a quantity of liquid brine for transport with said vehicle; and mixing said brine with said granular material within said transport mechanism and delivering said mixed material and brine to said first and second outlets.

18. The method of claim 17 including the steps of:

providing a spray assembly supported by said frame and generally oriented transversely with respect to said forward direction having a plurality of fluid outlets and coupled in fluid transfer communication with said quantity of liquid brine; and dispensing said liquid brine through said fluid outlets when said vehicle is moving upon an ice free bridge deck.

19. The method of claim 17 in which said transport mechanism includes a cross auger mechanism mounted at said vehicle forward frame region and extending in material delivery relationship between said first and second outlets; and said mixing step is carried out by delivering said brine to said cross auger mechanism.

20. The method of claim 15 in which each said first and second band has a width of less than about one foot.

21. The method of claim 15 in which said given forward velocity is at least about forty miles per hour.

22. The method of claim 15 in which said ejection direction is downward toward said highway at an acute angle with respect to said plane.

23. The method of claim 15 in which said injection direction is downward at an acute angle with respect to said plane of less than about 15°.

24. In a vehicle having a frame supporting forwardly and rearwardly disposed wheel assemblies movable along paths of travel, an engine and a cab, said frame having a support portion extending from a forward frame region adjacent said cab to a rearward frame region adjacent said rearwardly disposed wheel assembly, said vehicle being movable over a plane defining highway at a given forward velocity and forward direction, the improved apparatus for depositing granular snow-ice treatment material upon said highway, comprising:

a bed supported upon said frame support portion for carrying a quantity of said material;

first transport apparatus mounted with said bed and actuable to move said material within said bed forwardly to a transport outlet at said forward frame region;

second transport apparatus supported at said forward frame region having an input in material receiving relationship with said transport outlet for conveying said material to a downwardly directed output; and an ejector mechanism supported at said forward frame region having an input for receiving material from said downwardly directed output and an ejector output for expelling said material downwardly at an acute angle with respect to said plane and with an ejection velocity and ejection direction effecting deposition of said material upon said highway as a continuous narrow band located forwardly of a said rearwardly disposed wheel assembly and within a said path of travel thereof.

25. The apparatus of claim 24 in which said ejection velocity and ejection direction exhibits a velocity and direction vector component corresponding with said vehicle given forward velocity and a direction opposite said forward direction.

26. The apparatus of claim 24 in which:

said bed is a dump bed actuable to pivotally elevate upwardly and downwardly; and said first transport mechanism is fixed to and movable with said bed.

27. The apparatus of claim 24 including a deflector mounted with said ejector mechanism and actuable to intercept said expelled material to divert it laterally.

28. The apparatus of claim 24 including a brine formation and dispensing assembly mounted at said forward frame region and having a brine dispensing outlet coupled in liquid delivery communication with said second transport apparatus for effecting the mixing of brine with said material.

29. The apparatus of claim 24 in which said continuous narrow band has a width of less than about one foot.

30. The apparatus of claim 24 in which said ejector mechanism deposits said material upon said highway as a compact narrow continuous pile evoking a brine formation which maintains a salt concentration effective to break an ice-pavement bond.

31. The method of depositing snow/ice salt-based treatment material onto a plane defining highway and bridge deck from a vehicle having a frame supporting forwardly disposed wheels, an engine, a cab, spaced apart first and second rearwardly disposed wheel assemblies and a support portion extending from a forward frame region rearwardly of and adjacent said cab to a rearward frame region adjacent said first and second rearwardly disposed wheel assemblies, said vehicle being moveable over said highway and bridge deck at a given forward velocity and forward direction, comprising the steps of:

providing a quantity of said treatment material for transport with said vehicle;

providing a transport mechanism mounted upon said vehicle for delivering said material to an outlet assembly;

providing a material accelerating assembly with said vehicle, having an input for receiving said material from said outlet assembly and an output for expelling said material with an ejection velocity and ejection direction effecting disposition of said expelled material at a select location upon said highway;

providing a spray assembly supported by said frame and generally oriented transversely with respect to said forward direction, having a plurality 6t downwardly directed fluid outlets and a brine input;

providing a brine supply assembly mounted supported by said frame and having a first brine dispensing outlet coupled in liquid delivering communication with said transport mechanism and a second brine dispensing outlet coupled in liquid delivering communication with said spray assembly brine input;

expressing brine from said spray assembly fluid outlets only when said vehicle is traversing a said bridge deck which is substantially clear of ice material in anticipation of imminent ice formation; and expressing said material from said accelerating assembly when said vehicle is traversing a clear or ice carrying said highway and an ice carrying said bridge deck.

32. The method of depositing granular snow/ice salt-based treatment material onto a plane defining highway from a vehicle having a frame supporting forwardly disposed, spaced apart wheels, an engine, a cab, spaced apart first and second rearwardly disposed wheel assemblies and a support portion extending from a forward frame region adjacent said cab to a rearward frame region adjacent said first and second rearwardly disposed wheel assemblies, said vehicle being movable over said highway at a given forward velocity and forward direction, comprising the steps of:

providing a quantity of said treatment material for transport with said vehicle;

providing a transport mechanism mounted upon said vehicle for delivering said material to first and second spaced apart outlets at said forward frame region;

providing a first material accelerating apparatus with said vehicle at said forward frame region, having a first input for receiving said material from said first outlet and a first output for expelling said material with an ejection velocity and ejection direction effecting deposition of said expelled material at a location upon said highway in confronting relationship with said first rearward wheel assembly;

providing a second material accelerating apparatus with said vehicle at said forward frame region, having a second input for receiving said material from said second outlet and a second output for expelling said material with an ejection velocity and ejection direction effecting deposition of said expelled material at a location upon said highway in confronting relationship with said second rearward wheel assembly;

expressing said material from selected said first and second outputs, said ejection velocity and direction having a velocity vector component substantially parallel with said plane of value corresponding with the value of said vehicle given velocity and a direction substantially opposite said vehicle direction, said material being expressed from said first and second outputs in a manner depositing said material on said highway as respective first and second bands each being formed forwardly of respective said first and second rearward wheel assemblies as a compact narrow continuous pile of material evoking a brine formation which maintains a salt concentration effective to break an ice-pavement bond;

providing a brine formation tank mounted upon said vehicle forward frame region having an upwardly open receiving chamber assembly having hopper-defining sides, a brine receiving and filtering chamber assembly in fluid communication with said receiving chamber assembly for receiving brine and a brine holding chamber assembly in fluid transfer communication with said brine receiving and filtering chamber and having a brine output port;

adding a quantity of granular salt to said brine formation tank along said hopper defining sides;

adding a quantity of water to said receiving chamber to form a brine; and conveying brine from said brine output port to said transport mechanism.

33. The method of claim 32 including the steps of:

providing a spray assembly supported by said frame and generally oriented transversely with respect to said forward direction, having a plurality of fluid outlets and coupled in fluid transfer communication with said brine output port; and causing said brine to flow from said fluid outlets when said vehicle is moving over an ice free bridge deck.

34. In a vehicle having a frame supporting forwardly and rearwardly disposed wheel assemblies movable along paths of travel, an engine and a cab, said frame having a support portion extending from a forward frame region adjacent said cab to a rearward frame region adjacent said rearwardly disposed wheel assembly, said vehicle being movable over a plane defining highway at a given forward velocity and forward direction, the improved apparatus for depositing granular snow-ice treatment material upon said highway, comprising:

a bed supported upon said frame support portion for carrying a quantity of said material;

first transport apparatus mounted with said bed and actuable to move said material within said bed forwardly to a transport outlet at said forward frame region;

second transport apparatus supported at said forward frame region having an input in material receiving relationship with said transport outlet for conveying said material to a downwardly directed output;

an ejector mechanism supported at said forward frame region having an input for receiving material from said downwardly directed output and an ejector output for expelling said material downwardly at an acute angle with respect to said plane and with an ejection velocity and ejection direction effecting deposition of said material upon said highway as a continuous narrow band located forwardly of a said rearwardly disposed wheel assembly and within a said path of travel thereof;

a brine formation and dispensing assembly mounted at said forward frame region and having a brine dispensing outlet coupled in liquid delivery communication with said second transport apparatus for effecting the moving of brine with said material; and said brine formation and dispensing assembly comprises:

an upwardly open receiving chamber assembly having hopper defining sides configured for receiving granular salt;

a brine receiving and filtering chamber assembly in fluid communication with said receiving chamber assembly for receiving brine;

a brine holding chamber assembly in fluid transfer communication with said brine receiving and filtering chamber and having a brine output port; and a pumping and brine distribution assembly coupled with said brine output port and said cross transport mechanism.

35. The apparatus of claim 34 in which said upwardly open receiving chamber assembly of said brine formation and dispensing assembly extends at least partially over said vehicle cab.

36. The method of depositing snow/ice salt-based treatment material onto a plane defining highway and bridge deck from a vehicle having a frame supporting forwardly disposed wheels, an engine, a cab, spaced apart first and second rearwardly disposed wheel assemblies and a support portion extending from a forward frame region rearwardly of and adjacent said cab to a rearward frame region adjacent said first and second rearwardly disposed wheel assemblies, said vehicle being moveable over said highway and bridge deck at a given forward velocity and forward direction, comprising the steps of:

providing a quantity of said treatment material for transport with said vehicle;

providing a transport mechanism mounted upon said vehicle for delivering said material to an outlet assembly;

providing a material accelerating assembly with said vehicle, having an input for receiving said material from said outlet assembly and an output for expelling said material with an ejection velocity and ejection direction effecting disposition of said expelled material at a select location upon said highway;

providing a spray assembly supported by said frame and generally oriented transversely with respect to said forward direction, having a plurality of downwardly directed fluid outlets and a brine input;

providing a brine supply assembly mounted supported by said frame and having a first brine dispensing outlet coupled in liquid delivering communication with said transport mechanism and a second brine dispensing outlet coupled in liquid delivering communication with said spray assembly, brine input;

expressing brine from said spray assembly fluid outlets only when said vehicle is traversing a said bridge deck which is substantially clear of ice material in anticipation of imminent ice formation;

expressing said material from said accelerating assembly when said vehicle is traversing a clear or ice carrying said highway and an ice carrying said bridge deck; and wherein said step for providing a brine supply includes the step of providing a brine formation tank mounted upon said vehicle having an upwardly open receiving chamber assembly, a brine receiving and filtering chamber assembly in fluid communication with said receiving chamber assembly for receiving brine and providing said first and second brine dispensing outlets;

adding a quantity of salt to said brine formation tank upwardly open receiving chamber assembly; and adding a quantity of water to said receiving chamber to form a brine.

* * * * *